US008680384B2

(12) United States Patent
Ishioka

(10) Patent No.: US 8,680,384 B2
(45) **Date of Patent: *Mar. 25, 2014**

(54) BOOKLET PAGE TURNING APPARATUS

(75) Inventor: Yukinobu Ishioka, Utsunomiya (JP)

(73) Assignee: Kabushiki Kaisha Toshiba, Tokyo (JP)

( * ) Notice: Subject to any disclaimer, the term of this patent is extended or adjusted under 35 U.S.C. 154(b) by 293 days.

This patent is subject to a terminal disclaimer.

(21) Appl. No.: 13/043,678

(22) Filed: Mar. 9, 2011

(65) Prior Publication Data

US 2012/0055755 A1 Mar. 8, 2012

(30) Foreign Application Priority Data

Sep. 8, 2010 (JP) ..... 2010-201402
Sep. 10, 2010 (JP) ..... 2010-203613
Feb. 18, 2011 (JP) ..... 2011-033339

(51) Int. Cl.
*G10G 7/00* (2006.01)

(52) U.S. Cl.
USPC ..... 84/487

(58) Field of Classification Search
USPC ..... 84/487, 486, 488–520
See application file for complete search history.

(56) References Cited

U.S. PATENT DOCUMENTS 7,714,221 B2 * 5/2010 Ishioka ..... 84/519
2009/0266224 A1 10/2009 Ishioka
2010/0328695 A1 * 12/2010 Kanda et al. ..... 358/1.12

FOREIGN PATENT DOCUMENTS

JP 2000-255804 9/2000
JP 2008-290307 12/2008
JP 2009-279925 12/2009

OTHER PUBLICATIONS

European Search Report dated Sep. 20, 2012.

* cited by examiner

*Primary Examiner* — Jianchun Qin
(74) *Attorney, Agent, or Firm* — Pillsbury Winthrop Shaw Pittman, LLP

(57) ABSTRACT

According to one embodiment, a booklet page turning apparatus includes a control device that performs control, such that the contact roller unit moves to the position below the page, thereafter the lower vacuum pad cancels sucking and holding the page and the booklet is conveyed for a predetermined distance, and thereafter the upper vacuum pad cancels sucking and holding the page, so that the page is turned.

4 Claims, 27 Drawing Sheets

BOOKLET PAGE TURNING APPARATUS

CROSS-REFERENCE TO RELATED APPLICATIONS

This application is based upon and claims the benefit of priority from Japanese Patent Applications No. 2010-201402, filed Sep. 8, 2010; No. 2010-203613, filed Sep. 10, 2010; and No. 2011-033339, filed Feb. 18, 2011; the entire contents of all of which are incorporated herein by reference.

FIELD

Embodiments described herein relate generally to a booklet page turning apparatus provided in, for example, a booklet printing machine to automatically turn a page of a booklet.

BACKGROUND

An example of this kind of page turning apparatus is known to have the following configuration. At a page turning position, a page-turning roller is brought into contact with an upper surface of a page of a booklet which is to be turned, and the page-turning roller is rotated. This causes the page to buckle and deform, and the page flips up above the page-turning roller. Then, the booklet is conveyed in this state, so that the page flipped up above the page-turning roller is brought down and turned.

By the way, a booklet including pages having a high degree of flexural rigidity has recently come along as part of improvement of added values. However, in the above flip-up method with the page-turning roller, it is difficult to turn a page having a high degree of flexural rigidity.

To solve this drawback, a page turning apparatus having upper and lower vacuum pads at a page turning position has been developed so that these vacuum pads turn even a page having a high degree of flexural rigidity.

In other words, the lower vacuum pad sucks and holds a lower surface side of a booklet conveyed to the page turning position so that the lower vacuum pad holds the booklet. Thereafter, the upper vacuum pad sucks and holds the uppermost page of the booklet having a high degree of rigidity, and the vacuum pad moves upward, so that the uppermost page is held upward along a rotational track about a rotational center at a stitch of the booklet. Then, a contact roller moves to a position below the page held upward, and the upper and lower vacuum pads stop sucking/holding the pages. Then, the booklet is sandwiched and conveyed by the contact roller and the conveyor roller, whereby the uppermost page is turned and brought down.

The contact roller has a bladed wheel for striking and separating pages below the uppermost page and held upward together with the uppermost page when the contact roller moves to a position below the uppermost page.

This turning apparatus mainly aims to freely turn pages of a booklet whose cover and some of inner sheets have a high degree of rigidity. Nonetheless, it is to be understood that this turning apparatus can process even a booklet including only flexible pages.

However, in the past, both of upper and lower sucking/holding pads stop sucking/holding the pages at a time. Therefore, not only the booklet but also the pages held upward by the upper sucking/holding pad are conveyed at a time when the booklet is sandwiched and conveyed by the contact roller and the conveyor roller. Therefore, there is a problem in that the bladed wheel comes into contact with the pages held upward and strikes the pages down.

DETAILED DESCRIPTION

In general, according to one embodiment a booklet page turning apparatus includes a conveying device for conveying a booklet to a page turning position along a conveying path, upper and lower vacuum pads configured to be pressed against and to suck and hold upper and lower surfaces of the booklet conveyed to the page turning position by the conveying device, a drive device for moving the upper vacuum pad to raise, by a predetermined angle, a page of the booklet in a direction for opening the booklet about a stitch of the booklet, a contact roller unit for moving into a position below the page raised by the predetermined angle, and a control device for performing control, such that the contact roller unit moves to the position below the page, thereafter the lower vacuum pad cancels sucking and holding the page and the booklet is conveyed for a predetermined distance, and thereafter the upper vacuum pad cancels sucking and holding the page, so that the page is turned.

Embodiments will be hereinafter explained with reference to drawings.

First Embodiment

Figure 1:
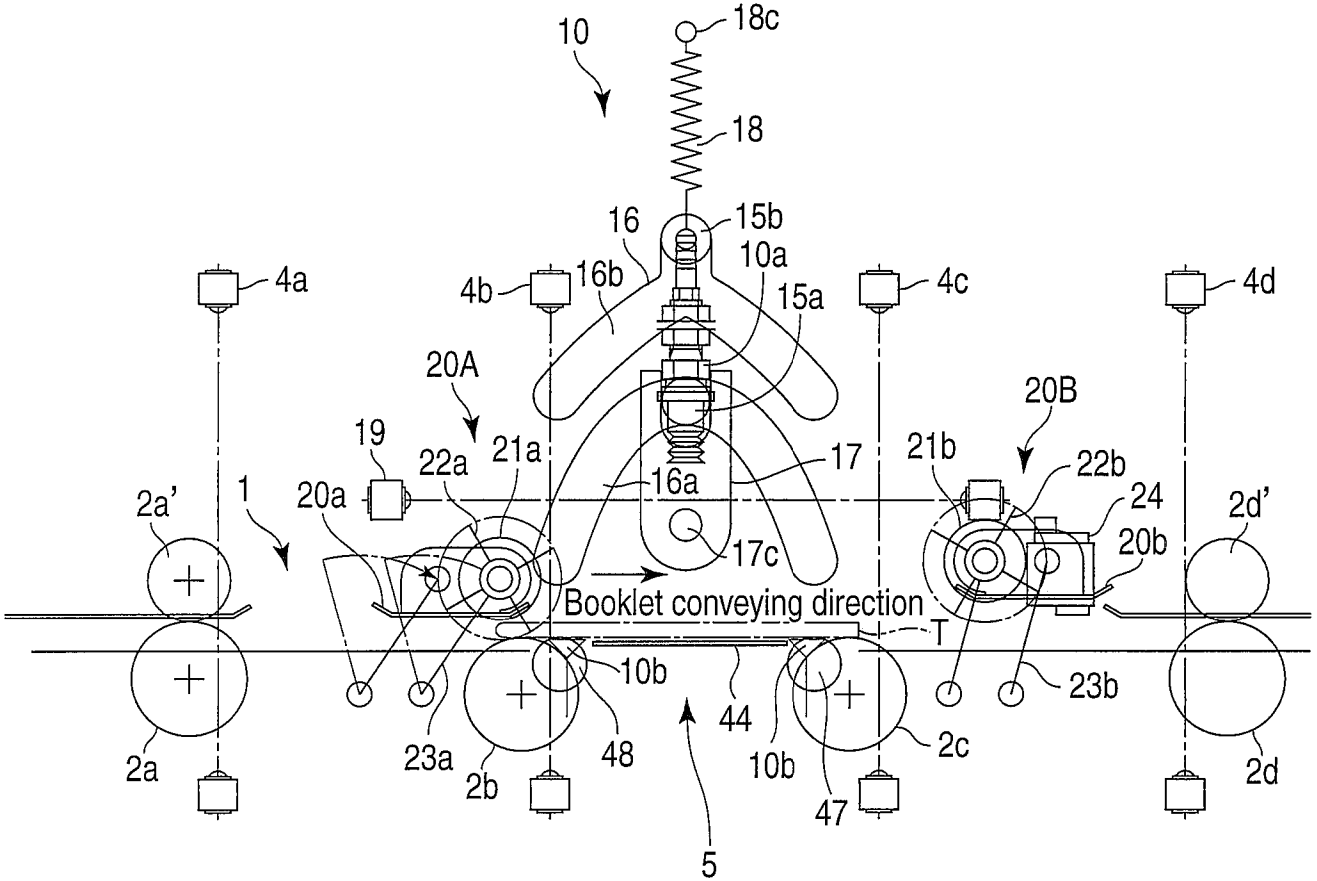
FIG. 1 is a schematic diagram illustrating a booklet page turning apparatus according to the first embodiment.

FIG. 1 is a schematic diagram illustrating a booklet page turning apparatus according to the first embodiment.

Figure 2:
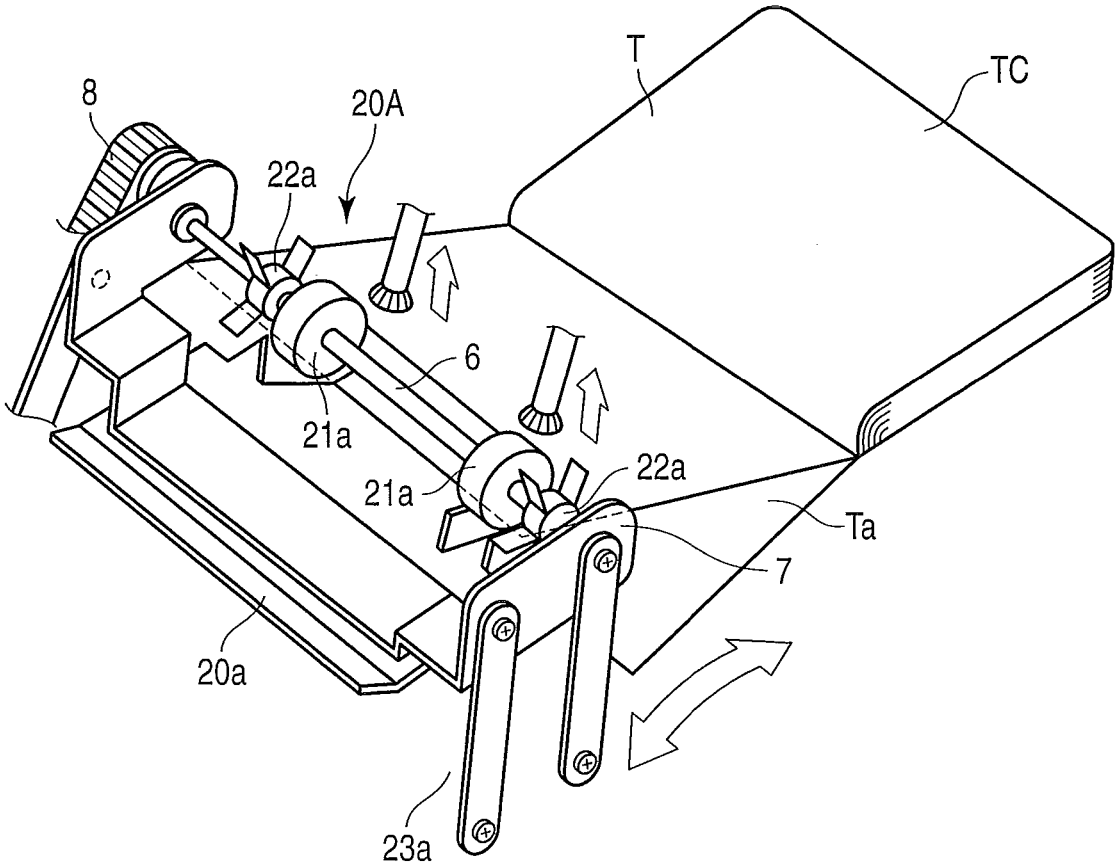
FIG. 2 is a perspective view illustrating pinch rollers, bladed wheels, and a driving system therefor in the page turning apparatus of FIG. 1.

In FIG. 1, numeral 1 denotes a conveying path for conveying a booklet T. The conveying path 1 is provided with a plurality of conveyor rollers 2*a* to 2*d* and detection sensors 4*a* to 4*d*. The conveyor rollers 2*a* to 2*d* serving as conveying devices are arranged with a predetermined interval in a conveying direction of a booklet T. The detection sensors 4*a* to 4*d* optically detect the booklet T. As shown in FIG. 2, the booklet T includes a highly rigid cover Ta and flexible inner sheets Tc.

Figure 5:
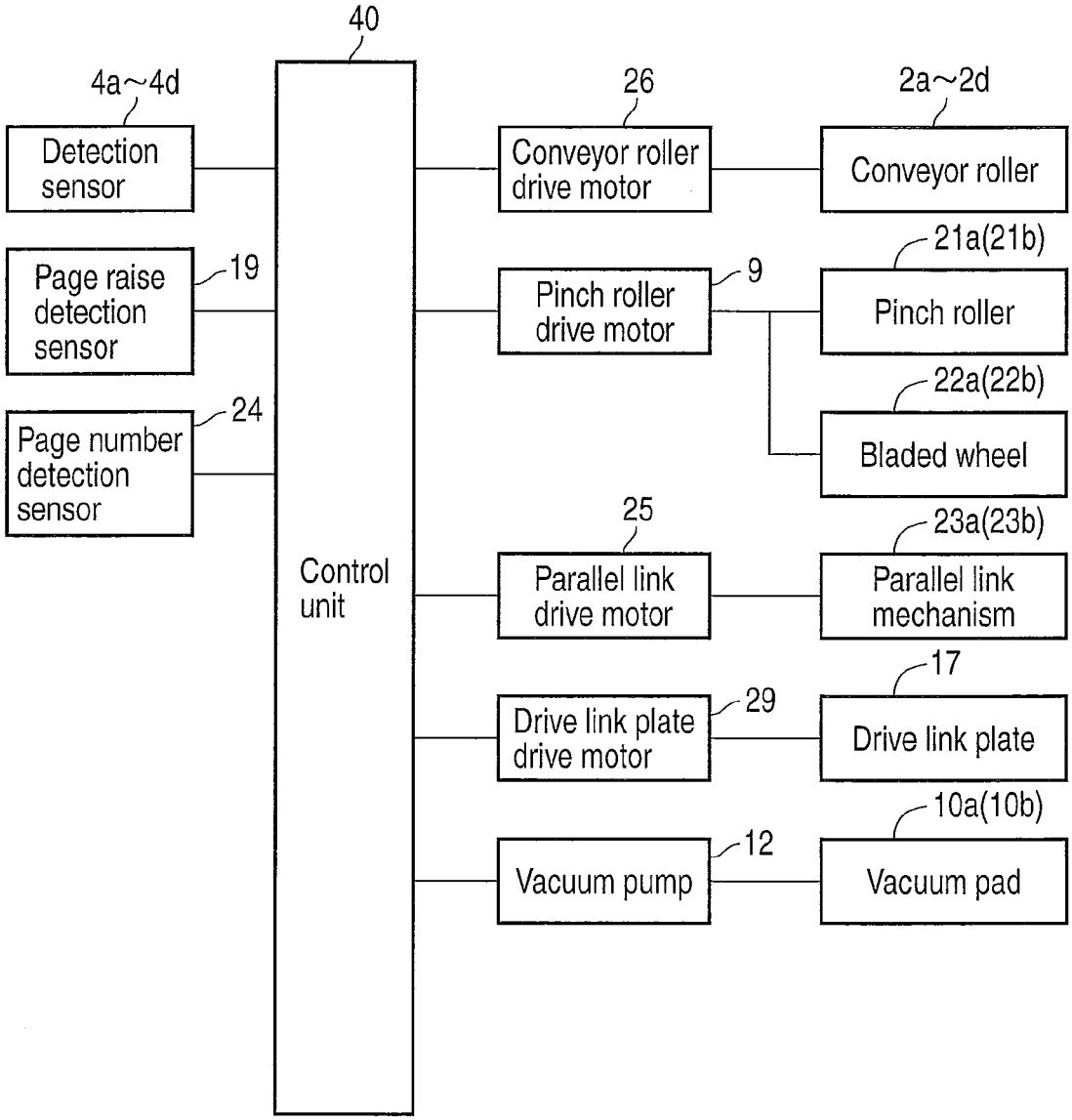
FIG. 5 is a block diagram illustrating a drive control system in the page turning apparatus of FIG. 1.

Pinch rollers 2*a*', 2*d*' are in rotatable contact with upper surface portions of the conveyor rollers 2*a*, 2*d*. The conveyor rollers 2*b*, 2*c* are arranged at a page turning position 5. The conveyor rollers 2*a* to 2*d* are rotated and driven by a conveyor roller drive motor 26 as shown in FIG. 5.

Contact feeding mechanisms 20A, 20B are respectively provided at upper sides of the conveyor rollers 2*b*, 2*c*. A page raise detection sensor 19 is provided at an upper side of the page turning position 5. The page raise detection sensor 19 optically detects a page sucked and raised by the pair of upper vacuum pads 10*a*.

In addition, a page number detection sensor 24 is provided in proximity to the contact feeding mechanism 20B. The page number detection sensor 24 serves as a detection device for detecting a page number of a turned page. The detection sensors 4*a* to 4*d*, the page raise detection sensor 19, and the page number detection sensor 24 are connected to a control unit 40 serving as a control device via a signal circuit as shown in FIG. 5.

On the other hand, the contact feeding mechanism 20A has pinch rollers 21*a* serving as second contact roller units. As shown in FIG. 2, the pinch rollers 21*a* is attached to a shaft 6. The shaft 6 has bladed wheels 22*a* attached in proximity to the pinch rollers 21*a*. A plurality of flexible striking plates are provided in a radiating manner on a peripheral surface portion of the bladed wheels 22*a*. The striking plates are brought into contact with the booklet T when the striking plates rotate, so that the striking plates strike down pages below a page to be turned.

FIG. 2 is a perspective view illustrating pinch rollers 21*a*, bladed wheels 22*a*, and a driving system therefor.

The shaft 6 is rotatably supported by a support bracket 7. One end of the shaft 6 protrudes from the support bracket 7 to the outside. A protruding portion of the shaft 6 is coupled with a pinch roller drive motor (shown in FIG. 5) 9 by way of a drive belt 8. When the pinch roller drive motor 9 drives the shaft 6, the pinch rollers 21*a* and the bladed wheels 22*a* are rotated and driven in the forward and backward directions.

A guide body 20*a* for guiding the conveyance of the booklet T is integrally attached to the support bracket 7. The support bracket 7 is supported by a parallel link mechanism 23*a*. The parallel link mechanism 23*a* pivots in the forward and backward directions when the parallel link mechanism 23*a* is driven by a parallel link drive motor (shown in FIG. 5) 25. When the parallel link mechanism 23*a* pivots, the guide body 20*a*, the pinch rollers 21*a*, and the bladed wheels 22*a* move between a conveying position and a retracted position. At the conveying position, they are in proximity to the conveyor roller 2*b*. The retracted position is obliquely upper left of the conveying position.

The contact feeding mechanism 20B has the same structure as the above contact feeding mechanism 20A.

In other words, the contact feeding mechanism 20B includes a guide body 20*b*, pinch rollers (first contact roller units) 21*b*, bladed wheels 22*b*, and a parallel link mechanism 23*b*. The contact feeding mechanism 20B is configured to move the guide body 20*b*, the pinch rollers 21*b*, and the bladed wheels 22*b* between a conveying position and a waiting position. At the conveying position, they are in proximity to the conveyor roller 2*c*. The waiting position is obliquely upper right of the conveying position.

A turning/sucking mechanism 10 is provided in the page turning position 5.

Figure 3:
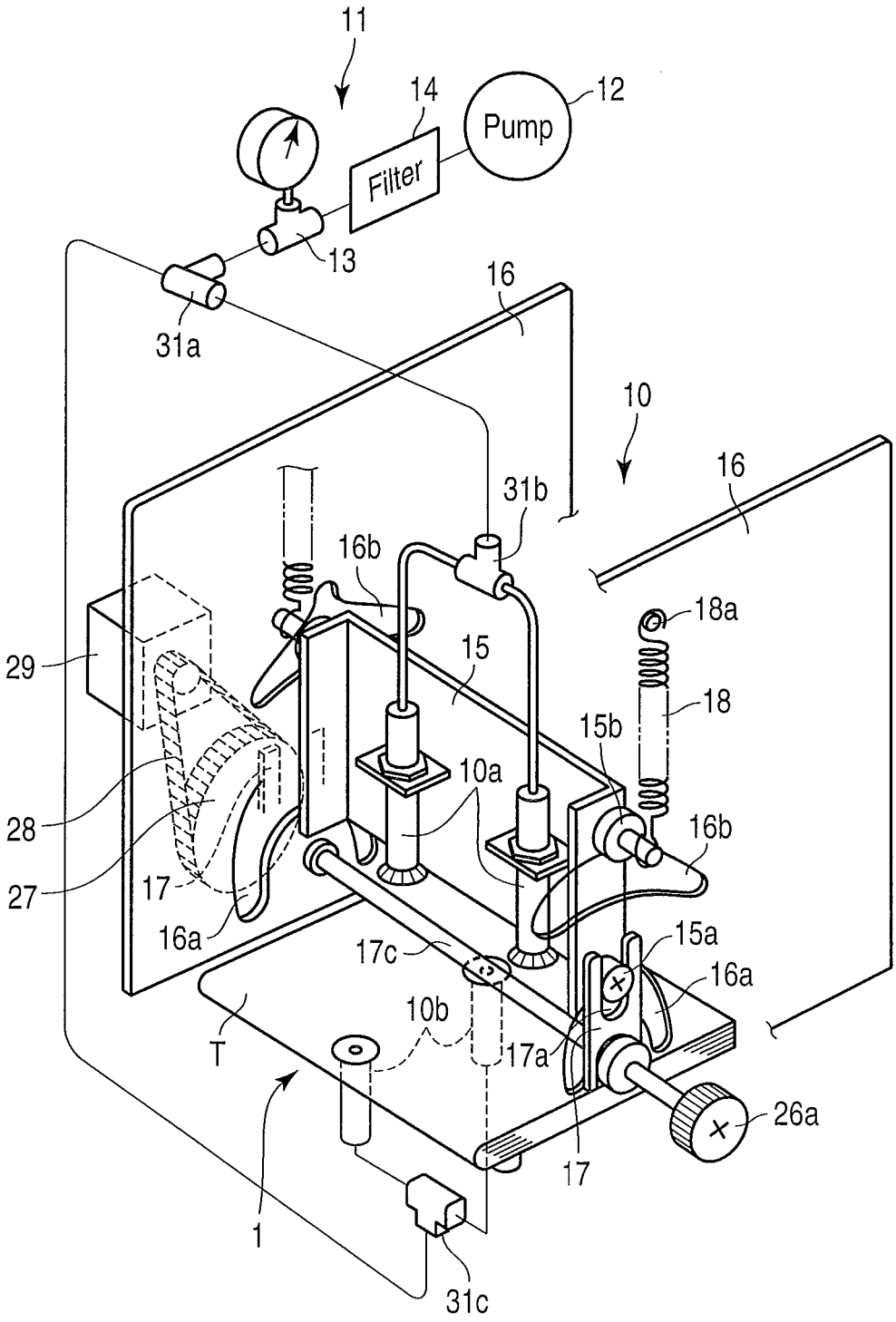
FIG. 3 is a perspective view illustrating vacuum pads and a driving system therefor in the page turning apparatus of FIG. 1.

The turning/sucking mechanism 10 will be hereinafter explained with reference to FIG. 3.

The turning/sucking mechanism 10 has the pair of upper vacuum pads 10 and the pair of lower vacuum pads 10*b*. The pair of upper vacuum pads 10*a* are provided at an upper side with respect to the conveying path 1. The pair of lower vacuum pads 10*b* are provided at a lower side with respect to the conveying path 1.

The lower vacuum pads 10*b* are arranged with a predetermined interval therebetween in the conveying direction of the booklet T such that sucking ports of the lower vacuum pads 10*b* face upward. The lower vacuum pads 10*b* face a lower surface side of the booklet T conveyed to a position immediately above the lower vacuum pads 10*b*.

The upper vacuum pads 10*a* are arranged with a predetermined interval therebetween in a direction perpendicular to the conveying direction of the booklet T such that sucking ports of the upper vacuum pads 10*a* face downward. The upper vacuum pads 10*a* are attached to a support carriage 15.

The upper and lower vacuum pads 10*a*, 10*b* are coupled with a vacuum pump 12 by way of a vacuum supply circuit 11. The vacuum supply circuit 11 includes a filter 14, a pressure meter 13, and branch tubes 31*a* to 31*c*. The filter 14 separates dust from air sucked by vacuum force.

When the vacuum pump 12 is activated, the upper and lower vacuum pads 10*a*, 10*b* are evacuated by way of the vacuum supply circuit 11, so that the upper and lower vacuum pads 10*a*, 10*b* suck and hold the upper and lower surfaces of the booklet T.

Sucking force W[N] of the vacuum pads 10*a*, 10*b* are obtained by the following expression.

$$W=0.1\times P\times A/S$$

P: vacuum pressure (gauge pressure) [−kPa]
A: vacuum pad size [$cm^2$]
S: margin of safety ratio Bent portions are formed at both side portions of the support carriage 15. Guide wheels 15*a*, 15*b* are respectively provided at upper and lower portions of the bent portion. Guide plates 16 are provided at both bent portions of the support carriage 15. The guide plates 16 face each other. Cam grooves 16*a*, 16*b* are formed at upper and lower portions of each of these guide plates 16. The guide wheels 15*a*, 15*b* of the support carriage 15 are engaged in these cam grooves 16*a*, 16*b*.

Further, the guide wheel 15*a* at the lower side passes through a cam groove 16*a* and is engaged in a groove portion 17*a* of a drive link plate 17 serving as a drive device. The drive link plate 17 is coupled with a drive shaft 17*c*. The drive shaft 17*c* extends between the guide plates 16, 16. A hand knob 26*a* is attached to one end side of the drive shaft 17*c*. A drive link plate drive motor 29 is coupled with the other side of the drive shaft 17*c* via a drive pulley 27 and a drive belt 28.

The shaft of the guide wheel 15*b* at the upper side is coupled with a hook portion 18*a* by means of a spring 18, so that the support carriage 15 is elastically urged upward.

When the drive link plate drive motor 29 is activated, the drive shaft 17*c* is rotated by means of the drive belt 28 and the drive pulley 27, so that the drive link plate 17 pivots in the forward and backward directions (right and left directions). With this rotation, the guide wheels 15*a*, 15*b* are guided along the two cam grooves 16*a*, 16*b* of the guide plate 16, whereby the support carriage 15 is moved.

In an initial state before the support carriage 15 is moved, the drive link plate 17 points the twelve o'clock direction, and the vacuum pads 10*a* supported by the support carriage 15 are retracted to the upper retracted position.

Figure 4:
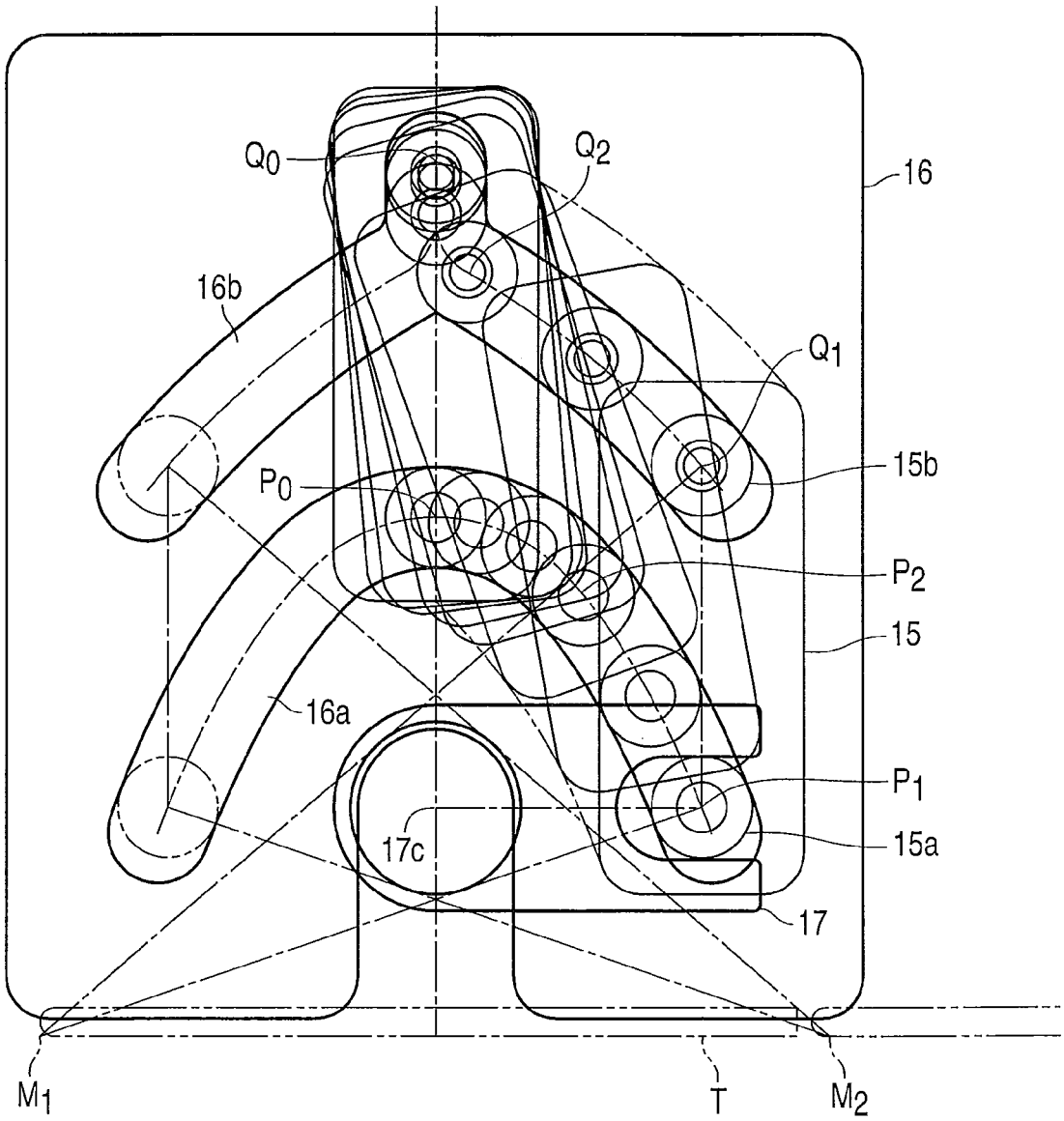
FIG. 4 is a figure illustrating trails of movement of the vacuum pads as shown in FIG. 3.

FIG. 4 illustrates a track of the support carriage 15 of the pads moving along the cam grooves 16*a*, 16*b* of the guide plate 16 at the page turning position 5 of the booklet T.

M1 denotes a stitch position of the booklet T at a page turning start position. M2 denotes a stitch position of the booklet T at a reverse page turning start position. Pn denotes a central position of the guide wheel 15*a*. Qn denotes a central position of the guide wheel 15*b*.

The position and the orientation of the support carriage 15 are determined by the two central positions Pn, Qn of the guide wheels 15*a*, 15*b*, and the vacuum pads 10*a* move in synchronization with the support carriage 15. In other words, a curve P1 to P2 and a curve Q1 to Q2 in the cam grooves 16*a*, 16*b* of the guide plate 16 are arcs each having a center at a point M1. Accordingly, between the curve P1 to P2 and the curve Q1 to Q1, the upper vacuum pads 10*a* move about the center M1 in accordance with life-up operation performed about a rotational center at the stitch of the cover of the booklet T.

When a page is turned backward, the upper vacuum pads 10*a* move about a center M2, and both of the shapes of the cam grooves 16*a*, 16*b* of the guide plate 16 and the movement of the upper vacuum pads 10*a* are symmetrical.

A curve P0 to P2 is formed with an arc smoothly connecting a curve symmetrically expanded from the curve P1 to P2. On the other hand, a curve Q0 to Q2 is formed to linearly extend backward in a direction of a symmetrical axis of the cam groove 16*b* of the guide plate 16.

Accordingly, the inclination of the support carriage 15 decreases, and when the central positions of the guide wheels 15*a*, 15*b* are P0, Q0, the support carriage 15 returns back to the vertical orientation at the upper retracted position (initial position) of the upper vacuum pads 10*a*.

The drive link plate 17 for moving the guide wheel 15*a* around the drive shaft (rotational center) 17*c* is in 12 o'clock direction at this occasion. The drive link plate 17 can symmetrically move the support carriage 15 in the clockwise direction and in the counterclockwise direction. Therefore, the maximum retracted position for the page turning operation performed with the upper vacuum pads 10*a* is the same as the turning start position for the reverse page turning operation, so that the page turning operation and the reverse page turning operation can be performed in a small range.

It should be noted that the actual stitch position of the booklet T and the positions M1 and M2 may change due to variation of the thickness of the booklet T, the binding method of the booklet T, arrangement of highly rigid pages within the booklet T, or the page turning start position changed due to the conveying operation. In the cover lift-up operation of the booklet T, the upper vacuum pads 10*a* may move along a track displaced from an ideal track. However, this does not cause much problem because the lift-up angle is less than 45 degrees which is small, and there is a margin between the booklet T and the upper vacuum pads 10*a* so that they may move to maintain balance. This margin is generated by elastic deformation of the upper vacuum pads 10*a* and elastic deformation in proximity to the booklet stitch.

When the booklet T is conveyed to the page turning position 5, the lower vacuum pads 10*b* are raised by a drive mechanism, not shown, and the lower vacuum pads 10*b* come into contact with the lower surface side of the booklet T to suck and hold the lower surface side. When the booklet T is conveyed from the page turning position 5, the lower vacuum pads 10*b* are lowered, and are separated from the lower surface side of the booklet T.

FIG. 5 is a block diagram illustrating the drive control system of the above page turning apparatus.

As described above, the detection sensors 4*a* to 4*d*, the page raise detection sensor 19, and the page number detection sensor 24 are connected to the control unit 40 serving as the control device via the signal circuit. Further, the control unit 40 is connected via the control circuit to drive motors 9, 25, 26, 29 for the pinch rollers, the parallel links, the conveyor rollers, and the drive link plates.

Subsequently, the page turning operation of the booklet T will be explained with reference to FIG. 6 to FIG. 15.

Figure 6:
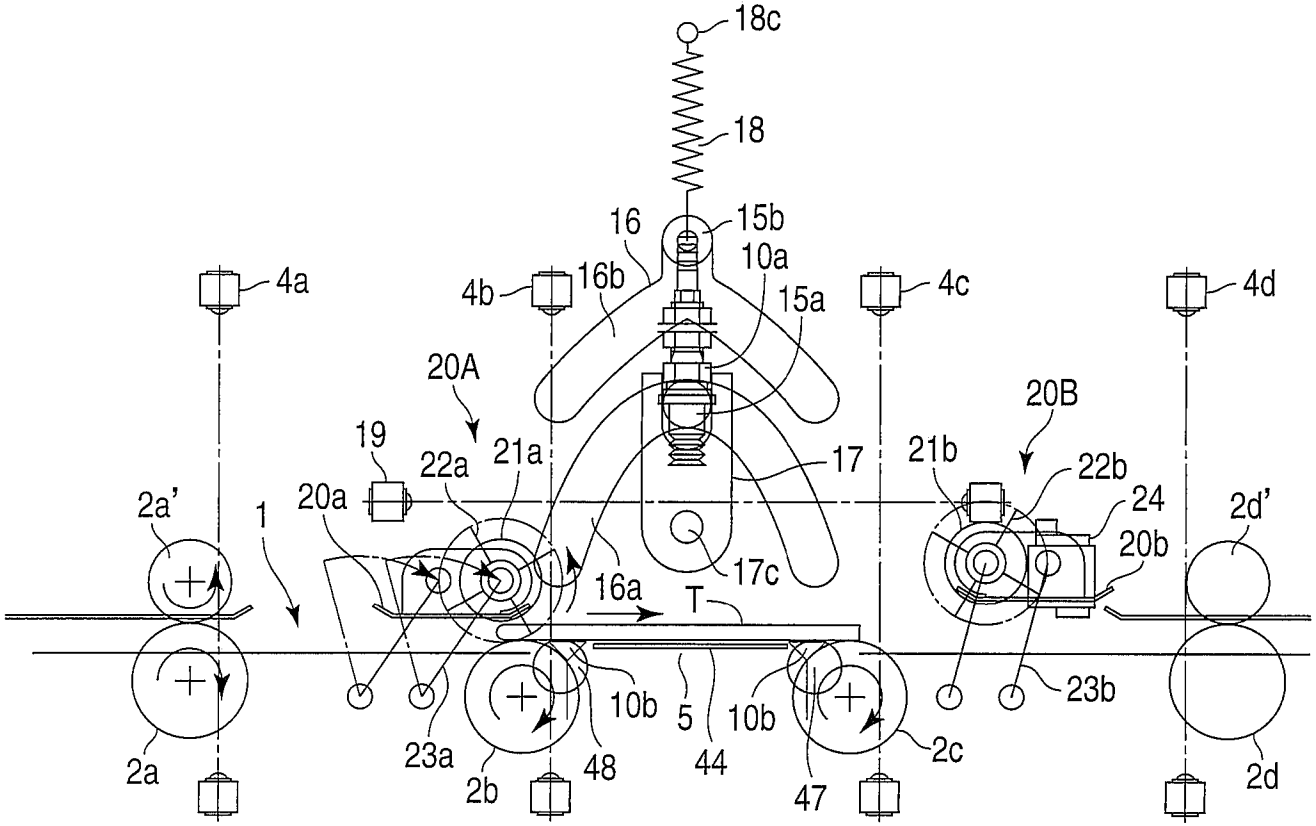
FIG. 6 is a figure illustrating the page turning apparatus of FIG. 1 when a booklet is conveyed to a page turning position.

As shown in FIG. 6, the booklet T is conveyed to the right along the conveying path 1 when the conveyor roller 2*a* rotates in the direction indicated by the arrow. As a result of this conveying operation, the booklet T is conveyed to the detection sensor 4*b*, and is detected by the detection sensor 4*b*. Then, the control unit 40 causes the pinch rollers 21*a* and the bladed wheels 22*a* to rotate in the direction indicated by the arrows, and activates the parallel link mechanism 23*a*. When the parallel link mechanism 23*a* is activated, the movable guide 20*a*, the pinch rollers 21*a*, and the bladed wheels 22*a* move from the retracted position to the conveying position, so that the booklet T is sandwiched between the conveyor roller 2*b* and the pinch rollers 21*a* and is further conveyed to the right.

When the booklet T is thus conveyed, a front end portion of the booklet T is detected by the detection sensor 4*c*. At this occasion, the conveyor roller 2*b* and the pinch rollers 21*a* are rotated backward for a predetermined number of pulses, so that the booklet T is conveyed backward. Then, the booklet T stops at the predetermined page turning position 5.

Figure 7:
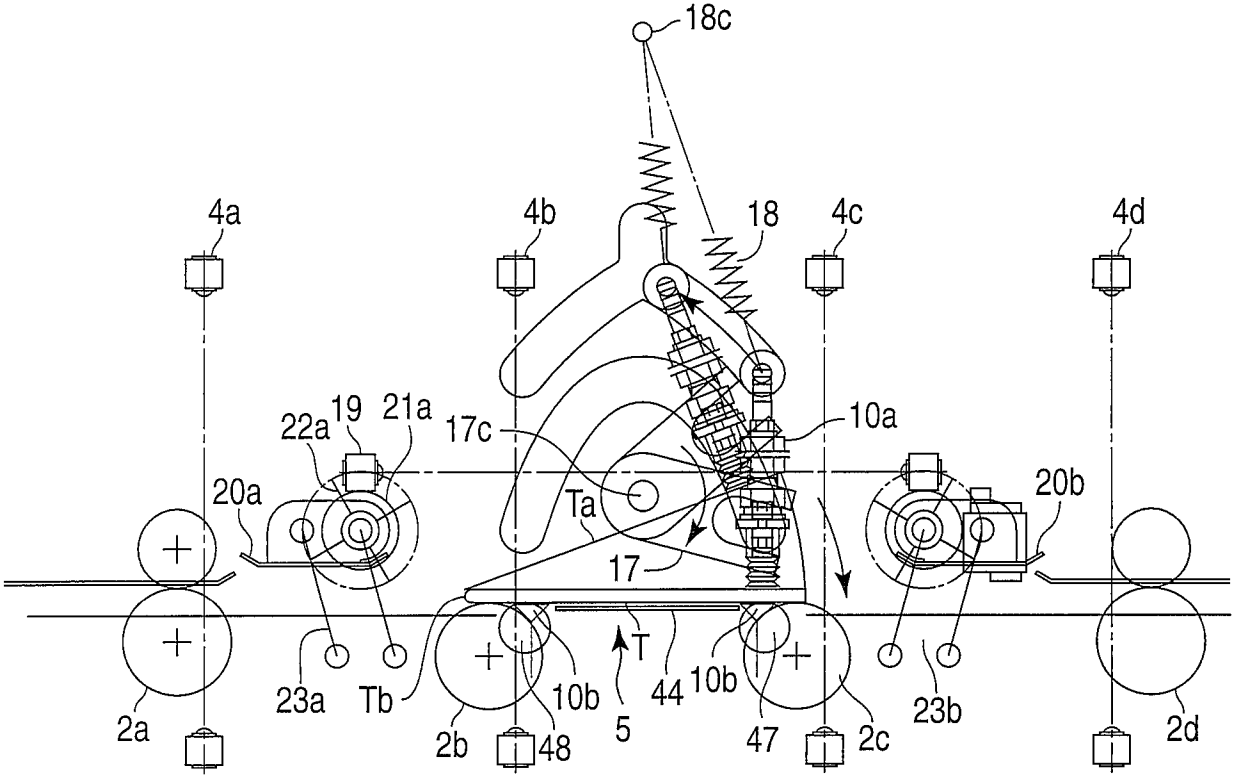
FIG. 7 is a figure illustrating the page turning apparatus when vacuum pads raise a cover of the booklet conveyed to the page turning position of FIG. 6.

Thereafter, as shown in FIG. 7, the parallel link mechanism 23*a* pivots in the counterclockwise direction, so that the movable guide 20*a*, the pinch rollers 21*a*, and the bladed wheels 22*a* move from the conveying position to the upper side, so that they are retracted.

On the other hand, the vacuum pump 12 is driven at this occasion, which evacuates the upper and lower vacuum pads 10*a*, 10*b*. Accordingly, the lower vacuum pads 10*b* are pressed against the lower surface side of the booklet T, and the lower vacuum pads 10*b* keep on sucking and holding the lower surface side. Further, at this occasion, the drive link plate drive motor 29 as shown in FIG. 5 is activated, so that the drive arm plate 17 pivots in the clockwise direction. Accordingly, the upper vacuum pads 10*a* are pressed against the cover Ta of the booklet T, and the upper vacuum pads 10*a* suck and hold the cover Ta.

Figure 8:
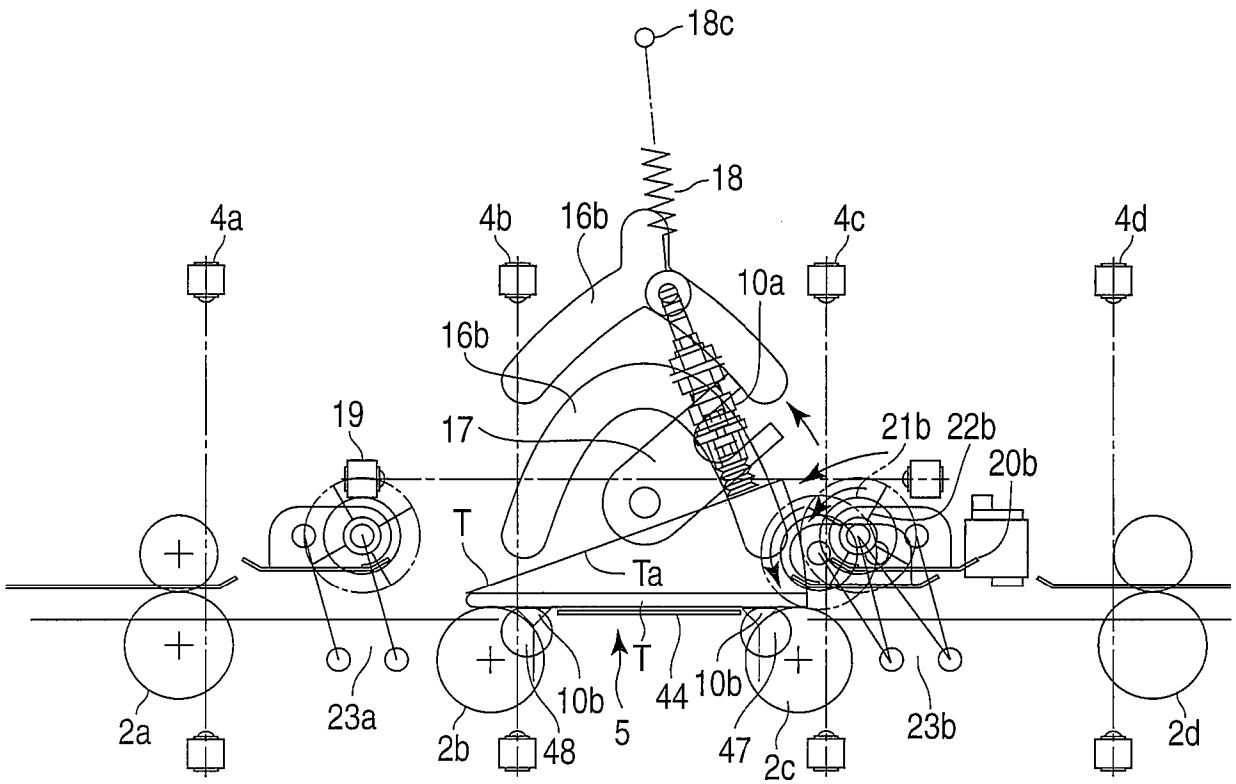
FIG. 8 is a figure illustrating the page turning apparatus when the pinch rollers move to a position below the cover raised by the vacuum pads of FIG. 7.

After the cover Ta is sucked and held, the drive arm plate 17 pivots in the opposite direction (counterclockwise direction) as shown in FIG. 8. Accordingly, while the upper vacuum pads 10*a* suck and hold the cover Ta, the upper vacuum pads 10*a* move upward along the cam grooves 16*a*, 16*b* of the guide plate 16.

As a result, the cover Ta of the booklet T is raised and turned about the rotational center at the stitch Tb of the booklet T while the sucking/holding state of the vacuum pads 10*a* is not changed. The cover Ta of the booklet T is simply raised and turned about the stitch Tb of the booklet T. No bending deformation force is applied thereto. Therefore, the turning operation is not affected by the rigidity of the page.

When the cover Ta of the booklet T is raised to a predetermined position as described above, the cover Ta of the booklet T is detected by the page raise detection sensor 19. Based on the detection, the control unit 40 causes the movable guide 20*b*, the pinch rollers 21*b*, and the bladed wheels 22*b* to move from the retracted position to the conveying position. At this occasion, the striking plates of the bladed wheels 22*b* strike and bring down a plurality of inner sheets below the cover Ta which come upward together with the raised cover Ta of the booklet T, and the pinch rollers 21*b* are inserted into a space above the page immediately under the cover Ta.

Figure 9:
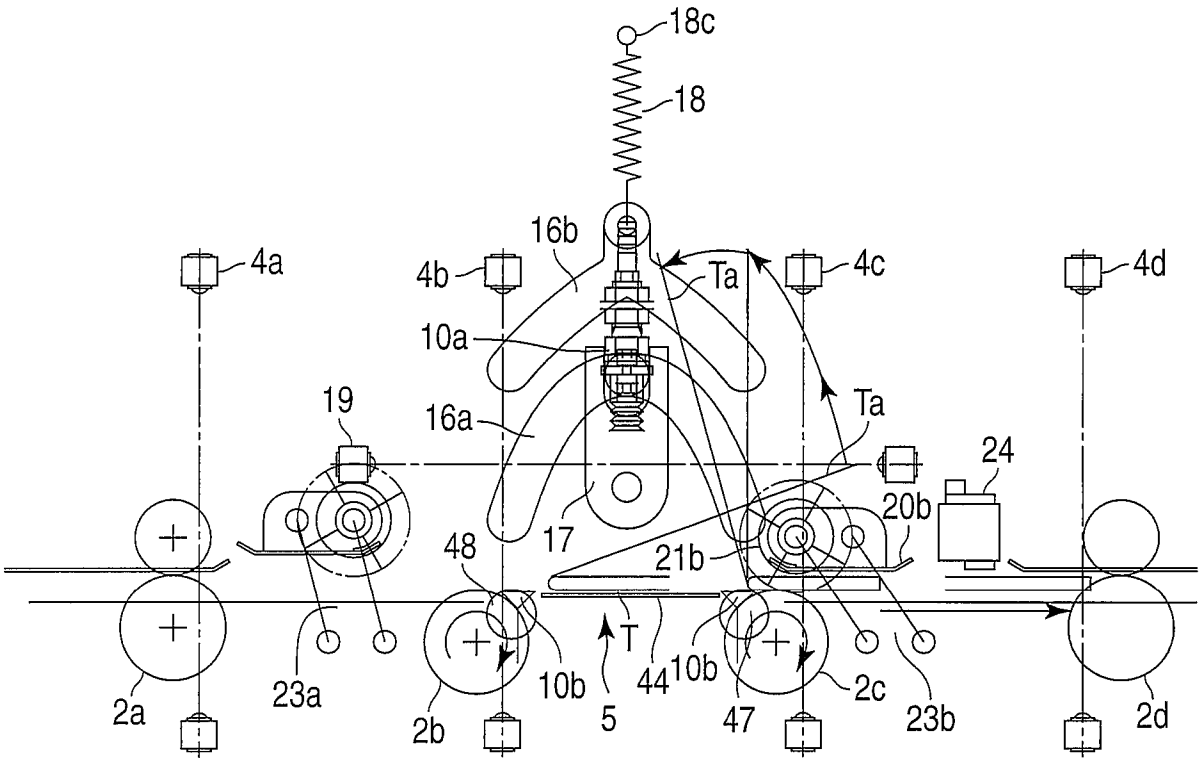
FIG. 9 is a figure illustrating the page turning apparatus when the booklet is conveyed while the pinch rollers move to a position below the cover of FIG. 8.

Thereafter, the upper and lower vacuum pads 10*a*, 10*b* stop sucking/holding the booklet T, and the drive link plate 17 is brought back to the initial 12 o'clock direction as shown in FIG. 9, so that the upper vacuum pads 10*a* are brought back to the upper retracted position. Then, the booklet T is sandwiched and conveyed by the conveyor roller 2*c* and the pinch rollers 21*b*, and when the booklet T is detected by the booklet detection sensor 4*d*, the conveying operation stops. As a result of this conveying operation, the pinch rollers 21*b* come into contact with the cover Ta of the booklet T to turn and bring down the cover Ta.

Figure 10:
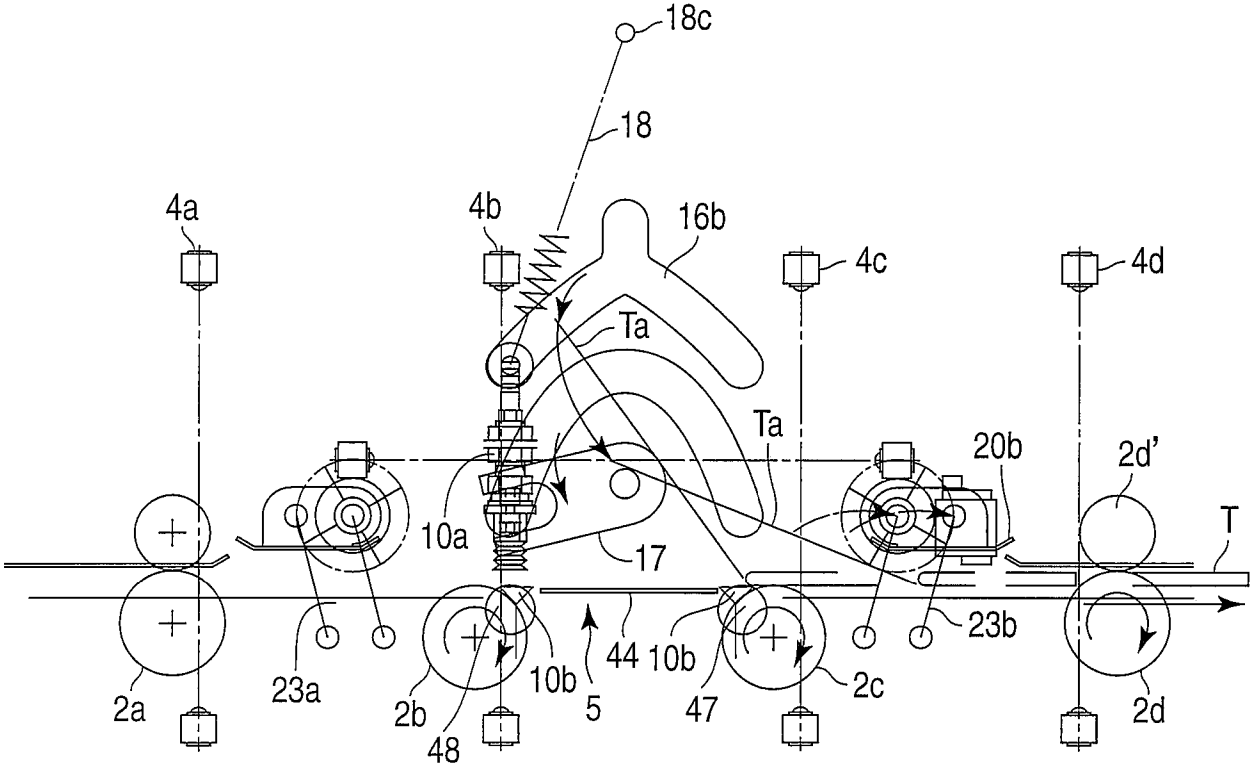
FIG. 10 is a figure illustrating the page turning apparatus when the booklet of FIG. 9 is conveyed so that the pinch rollers come into contact with the cover to turn and bring down the cover.

At this occasion, the drive link plate 17 further pivots in the counterclockwise direction from the retracted state, so that as shown in FIG. 10, the upper vacuum pads 10*a* move out of a range in which the cover Ta of the booklet T is turned and brought down. At this occasion, the right end of the booklet T is already sandwiched by the conveyor roller 2*d* and the pinch roller 2*d*', and is thus ready to be conveyed. The movable guide 20*b* is returned back to the retracted position.

Figure 11:
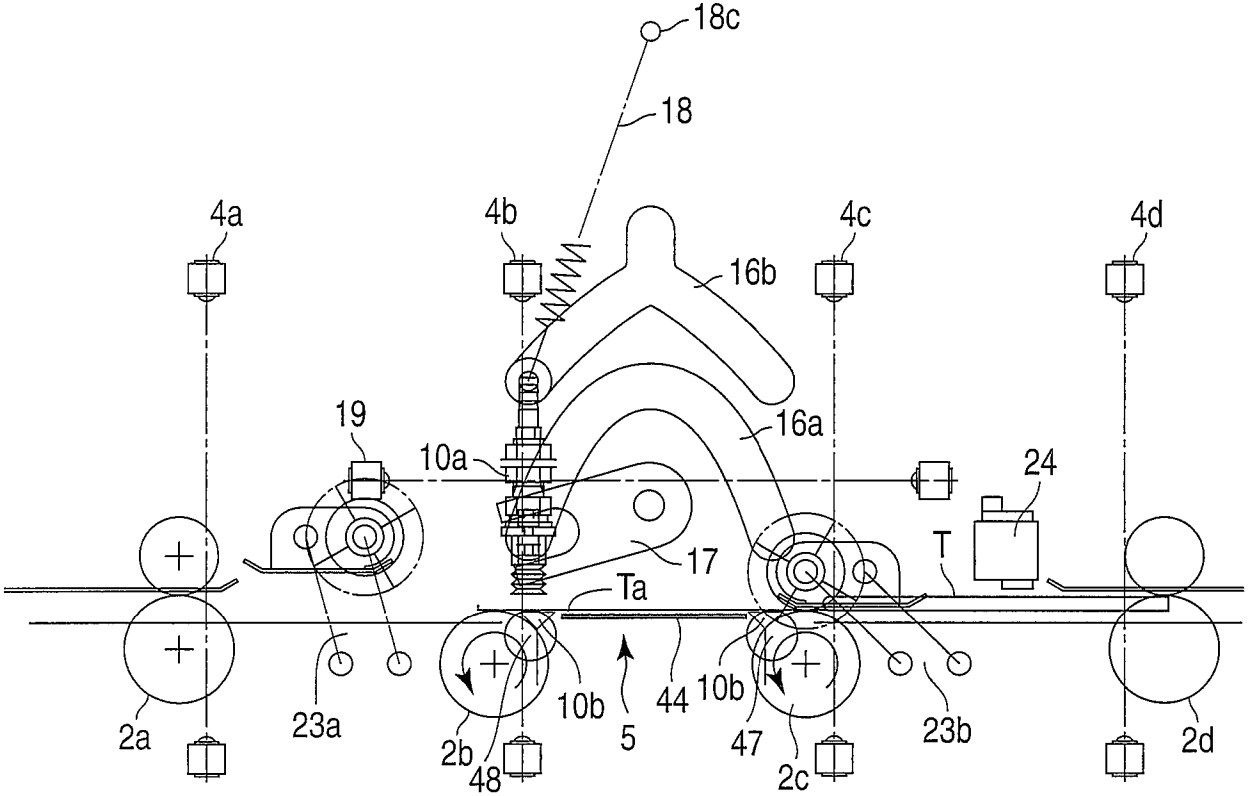
FIG. 11 is a figure illustrating the page turning apparatus when the cover of FIG. 10 is completely turned and opened.

The conveyor roller 2*d* rotates in this state, so that the cover Ta of the booklet T raised upward is completely turned and brought down as shown in FIG. 11 while there is no interfering component therearound. Therefore, even in this state, the operation can be completed without relying on the rigidity of the page at all.

Figure 12:
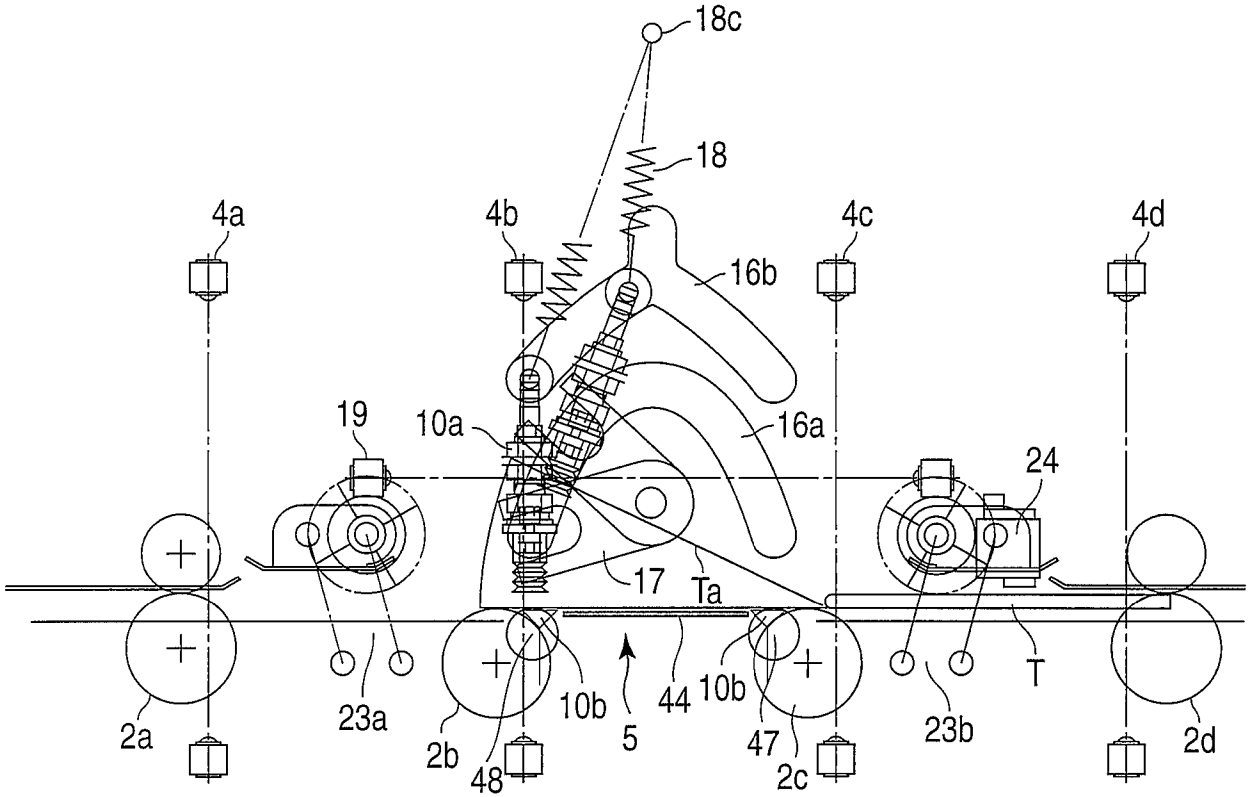
FIG. 12 is a figure illustrating the page turning apparatus when the cover completely turned and brought down in FIG. 11 is raised by the vacuum pads in the reverse turning direction.
Figure 13:
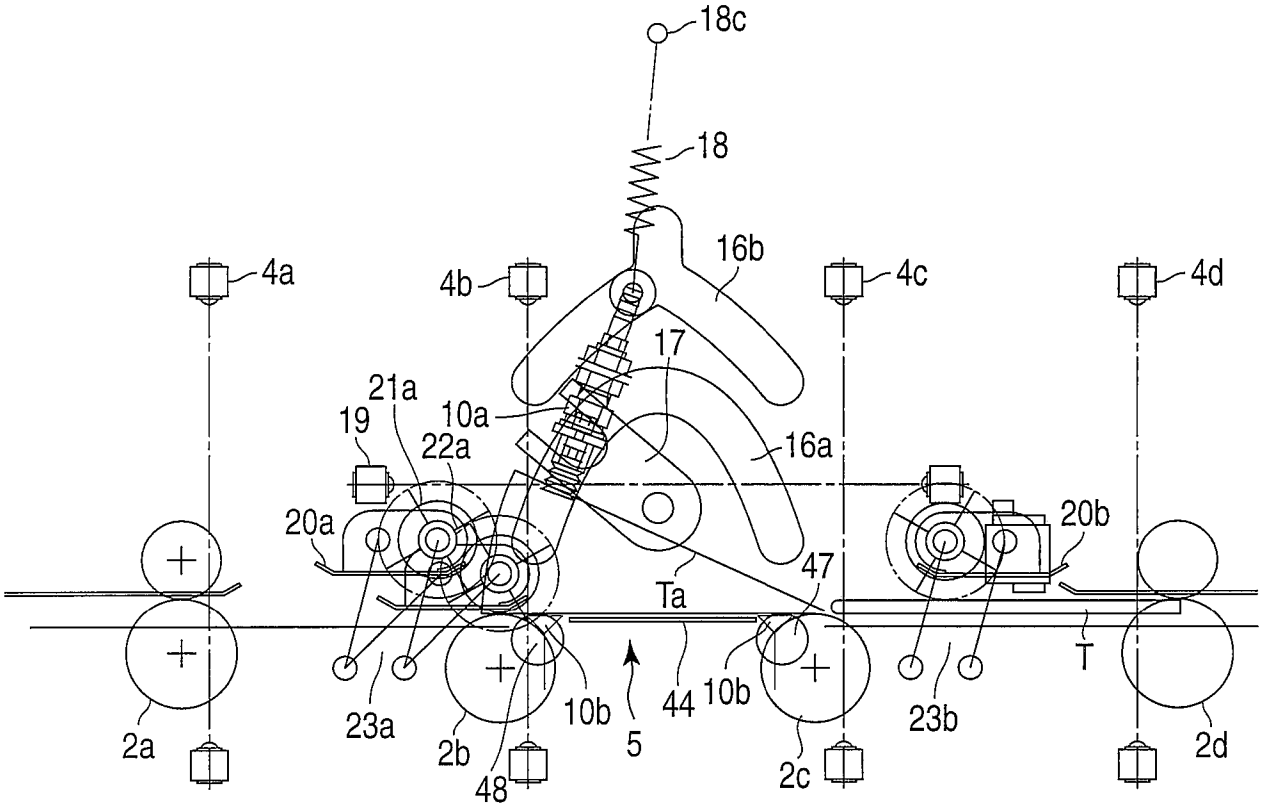
FIG. 13 is a figure illustrating the page turning apparatus when the pinch rollers move to a position below the cover raised in FIG. 12.
Figure 14:
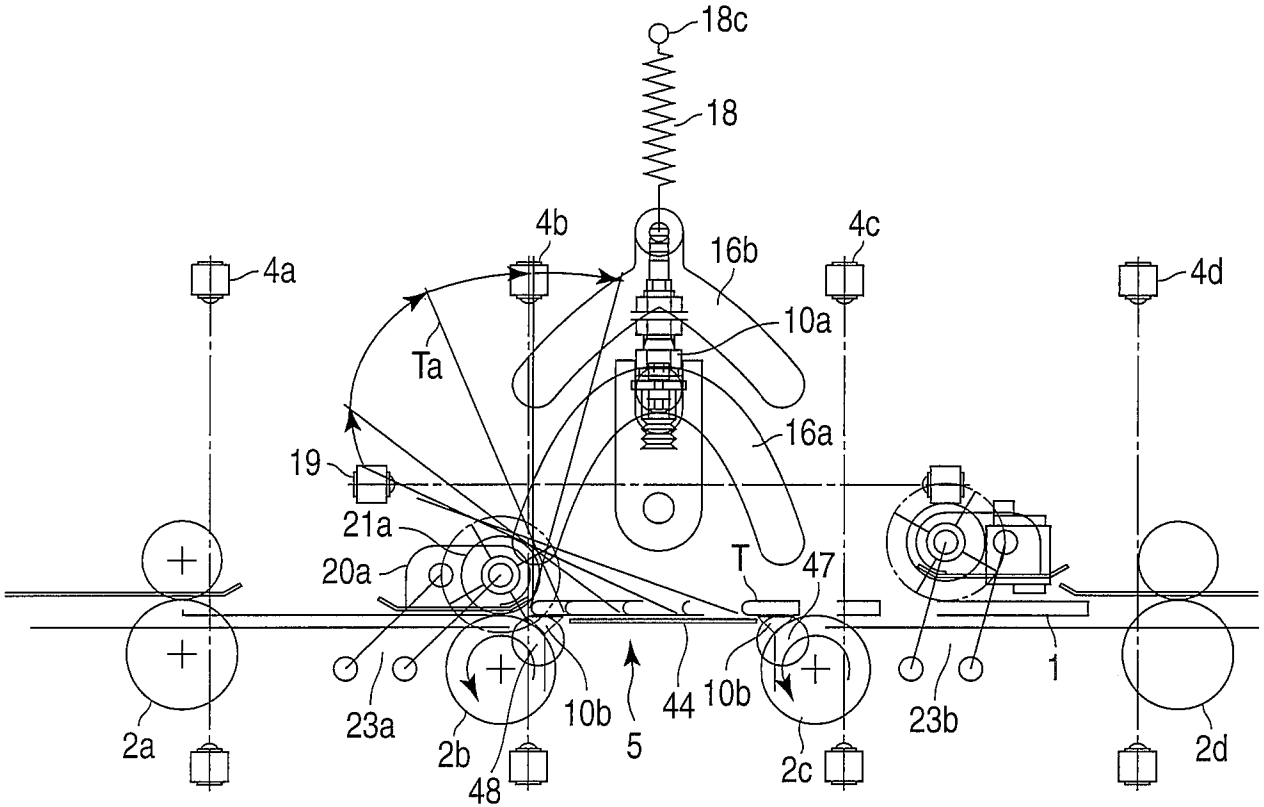
FIG. 14 is a figure illustrating the page turning apparatus when the pinch rollers having moved to the position below the cover in FIG. 13 come into contact with the cover.
Figure 15:
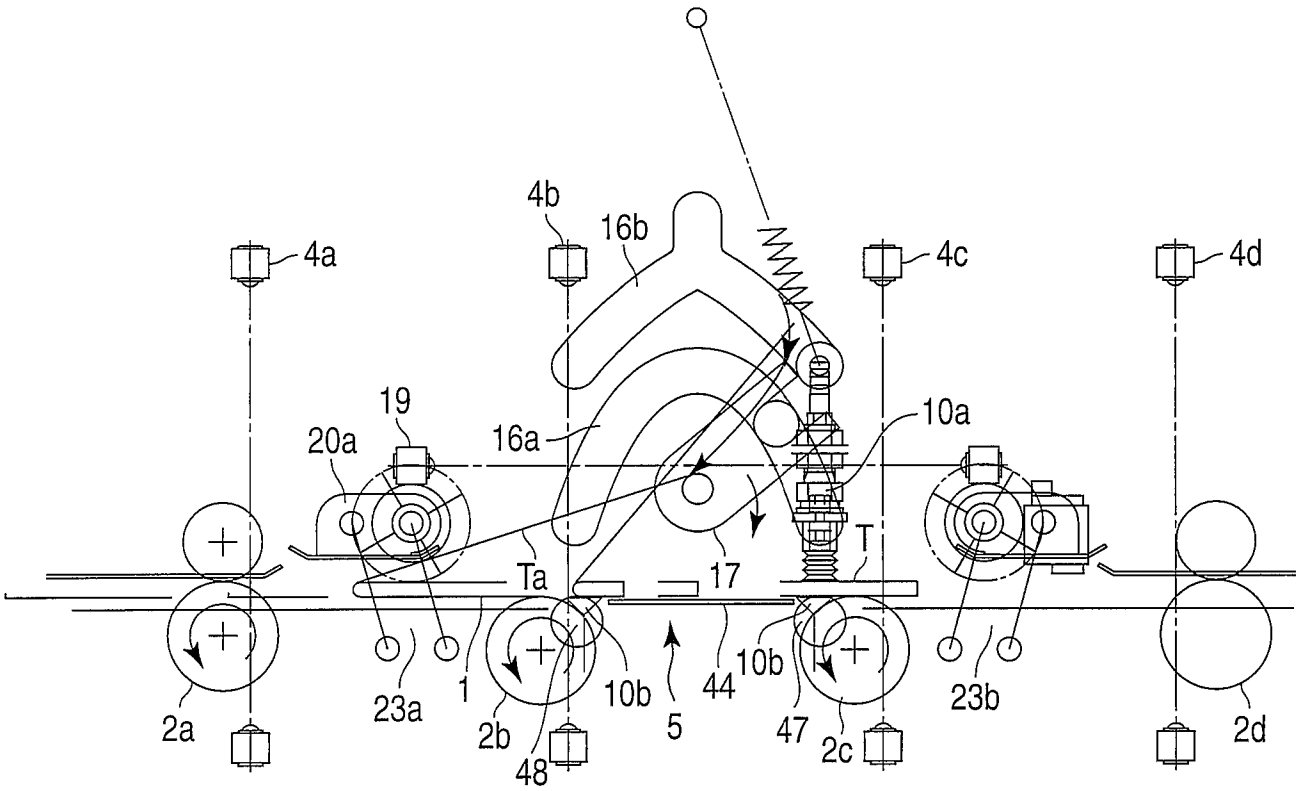
FIG. 15 is a figure illustrating the page turning apparatus when the cover brought into contact with the pinch rollers in FIG. 14 are greatly pivoted in the reverse turning direction.

During this conveying operation, the page number detection sensor 24 scans a page number recorded on the opened cover Ta of the booklet T. This scanned information is transmitted to the control unit 40. The control unit 40 determines, on the basis of the scanned information, whether the page turning operation is performed according to a program. When the page turning operation is determined to be performed according to the program, the booklet T is conveyed to a subsequent step and is processed. After this processing, the booklet T is conveyed backward to the page turning position 5 again as shown in FIG. 11. In this state, the upper vacuum pads 10*a* suck and raise the cover Ta as shown in FIG. 12. When the page raise sensor 19 detects the raised cover Ta, the movable guide 20*a*, the pinch rollers 21*a*, and the bladed wheels 22*a* move to the right and move to a position below the cover Ta as shown in FIG. 13. Thereafter, as shown in FIG. 14, the conveyor rollers 2*b*, 2*c*, 2*d* rotate in the directions indicated by the arrows whereby the booklet T is conveyed to the left. As a result, the cover Ta comes into contact with the pinch rollers 21*a* and turns in a closing direction. Then, the booklet T is further conveyed to the left as shown in FIG. 15, so that the cover Ta is turned in the closing direction and the cover Ta is closed. The page closing operation is terminated. During this page closing operation, the vacuum pads 10*a* is retracted from the waiting position to the lower right side so that the vacuum pads 10*a* does not come into contact with the cover Ta greatly turning in the closing direction.

Figure 17:
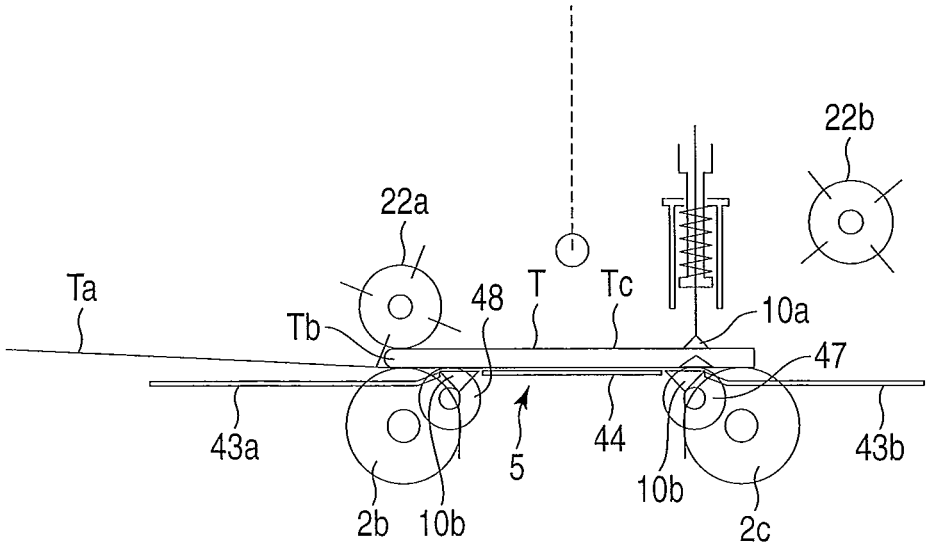
FIG. 17 is a figure illustrating the page turning apparatus of FIG. 16 when it is seen from a direction indicated by arrow A.
Figure 18:
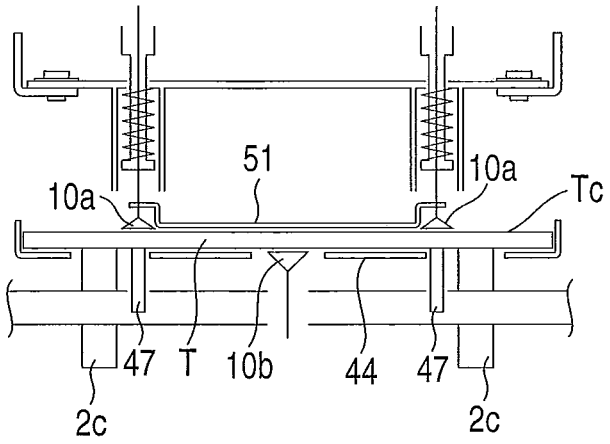
FIG. 18 is a figure illustrating the page turning apparatus of FIG. 16 when it is seen from a direction indicated by arrow B.

By the way, as shown in FIG. 17, guide bodies 43*a*, 43*b* for guiding the conveying process of the booklet T are respectively provided at the upstream side and the downstream side of the page turning position 5 in the booklet conveying direction. As shown in FIG. 18, a conveying guide 44 is provided at the page turning position 5. The conveying guide 44 serves as a conveying guide body for guiding the conveying process of the booklet T.

The conveying guide 44 is arranged at a position higher by a predetermined size than the upstream side and downstream side guide bodies 43*a*, 43*b*. In other words, a distance between top portions of the conveyor rollers 2*b*, 2*c* and the conveying guide 44 is less than a distance between the top portions of the conveyor rollers 2*b*, 2*c* and the guide bodies 43*a*, 43*b*.

Further, the distance between top portions of the conveyor rollers 2*b*, 2*c* and the conveying guide 44 is greatly larger than the amount of digging (nip) for which the booklet T digs into the conveyor rollers 2*b*, 2*c* by pinch pressures of the pinch rollers 21*a*, 21*b*.

Figure 16:
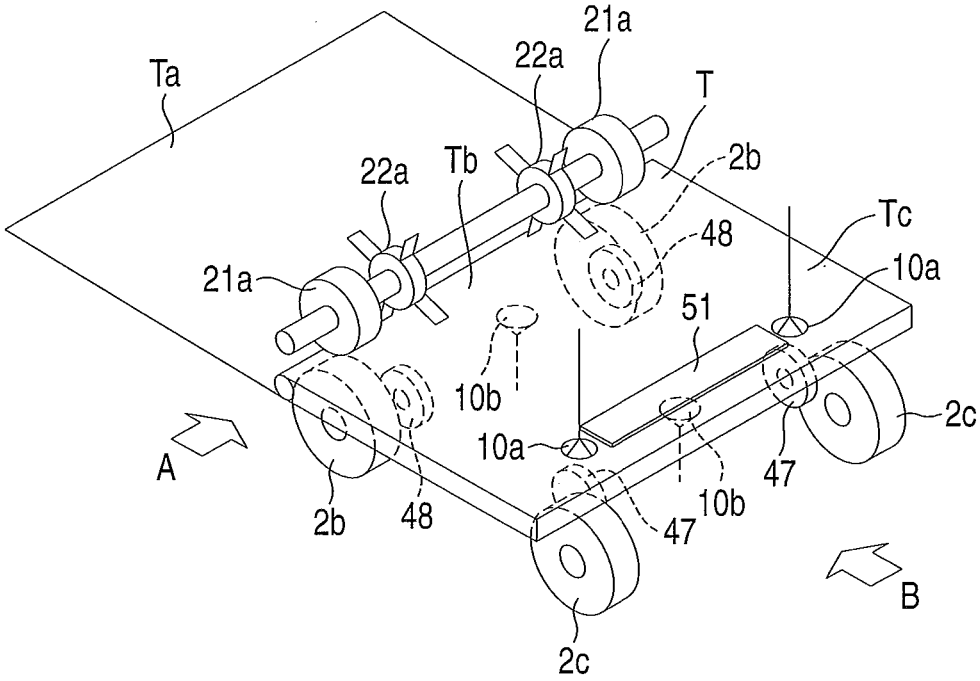
FIG. 16 is a perspective view illustrating the page turning apparatus when the booklet whose cover is opened in FIG. 11 is conveyed to the page turning position at which inner sheets are turned.

On the other hand, a receiving plate 51 is integrally provided between the pair of upper vacuum pads 10*a* as shown in FIG. 16 and FIG. 18. A lower surface position of the receiving plate 51 is greatly higher than a pad sucking/holding surface of the upper vacuum pads 10*a* when the upper vacuum pads 10*a* deforms by being pressed against the booklet T.

One of the pair of lower vacuum pads 10*b* is located immediately under the receiving plate 51 to be pressed against the lower surface portion of the booklet T. The other of the pair of lower vacuum pads 10*b* is arranged to be pressed against a position in proximity to a highly rigid stitch portion Tb of the booklet T.

The top portions of the conveyor rollers 2*b*, 2*c* protrude from the conveying guide 44 so as to apply appropriate conveying force to the lower surface of the booklet T. An appropriate gap is formed between the top portions of the conveyor rollers 2*b*, 2*c* and the conveying guide 44, so that no abrasion is formed on the surface when the booklet T is conveyed.

At the page turning position 5, however, the conveying process of the booklet T with the conveyor rollers 2*b*, 2*c* is once halted. Therefore, the gap between the top portions of the conveyor rollers 2*b*, 2*c* and the conveying guide 44 can be reduced.

Further, auxiliary rollers 47 are provided immediately under the booklet portion against which the upper vacuum pads 10*a* are pressed. On the other hand, auxiliary rollers 48 are provided in proximity to the conveyor roller 2*b*, 2*b*. The auxiliary rollers 47, 48 are provided so that the top portion of the auxiliary rollers 47, 48 are at the same height as the top portions of the conveyor rollers 2*b*, 2*c*.

The auxiliary rollers 47, 48 are provided to prevent abrasion formed on the booklet T and avoid jamming when the booklet T is conveyed. In addition, the auxiliary rollers 47, 48 prevents deformation of the booklet T that may be caused when the upper vacuum pads 10*a* are pressed against the booklet T. Therefore, the auxiliary rollers 47, 48 are not limited to rollers. Smooth protruding portion materials may be used as the auxiliary rollers 47, 48, and the top portions of the materials may come into contact with the lower surface of the booklet T.

Alternatively, a conveying belt may be used instead of the conveyor roller 2*b*, 2*b* at the page turning position 5. In this case, without using the auxiliary rollers 47, 48, the entire lower surface of the booklet T can be supported so that the entire lower surface of the booklet T becomes a certain flat surface.

Subsequently, the page turning operation of flexible inner sheets Tc of the booklet T will be explained.

First, as shown in FIG. 16 to FIG. 18, the booklet T having the cover Ta opened reaches the page turning position 5. At this occasion, the upper vacuum pads 10*a* are pressed against the upper surface portion of the inner sheet Tc. At the same time, the lower vacuum pads 10*b* are pressed against the lower surface portion of the booklet T, and the lower vacuum pads 10*b* suck and hold the lower surface portion.

Figure 19:
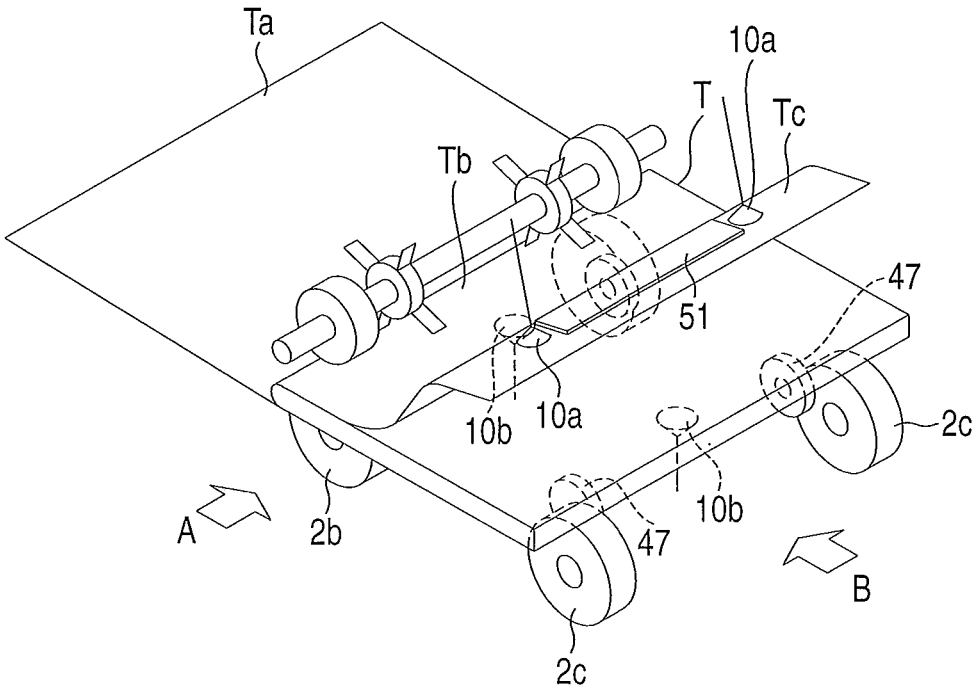
FIG. 19 is a perspective view illustrating the page turning apparatus of FIG. 16 when the upper vacuum pads raise an inner sheet.
Figure 20:
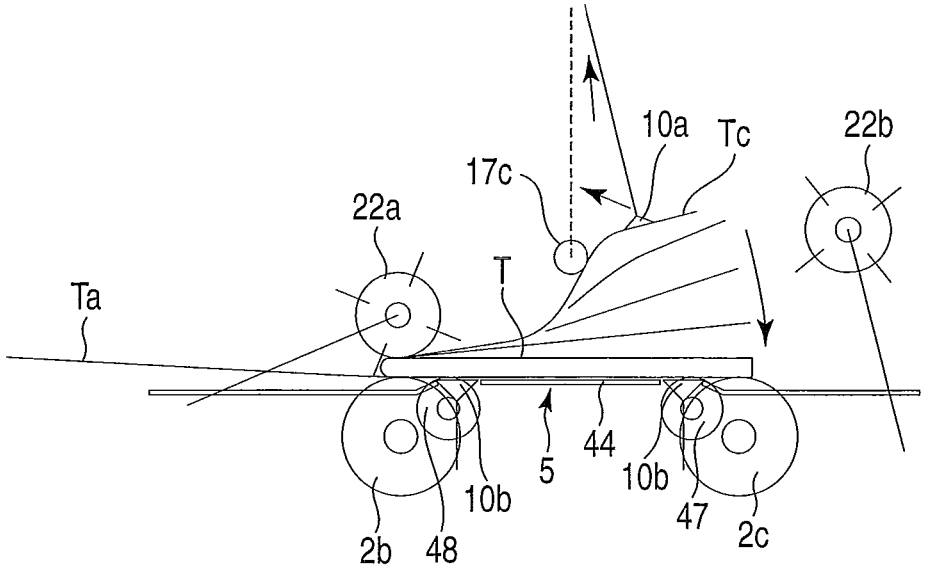
FIG. 20 is a figure illustrating the page turning apparatus of FIG. 19 when it is seen from a direction indicated by arrow A.
Figure 21:
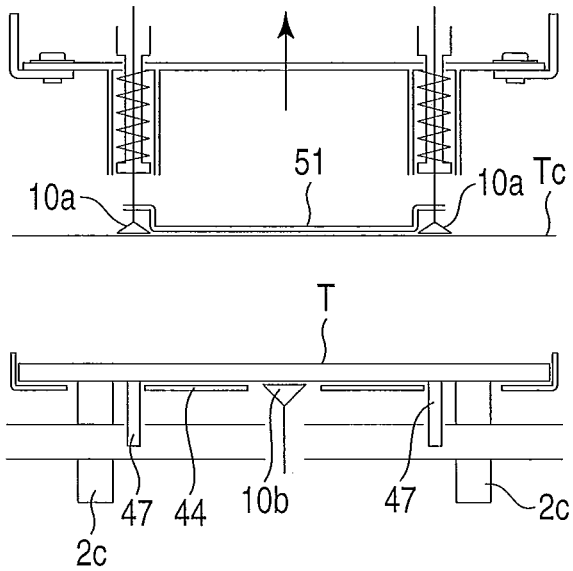
FIG. 21 is a figure illustrating the page turning apparatus of FIG. 19 when it is seen from a direction indicated by arrow B.

After the cover Ta is sucked and held, the upper vacuum pads 10*a* move upward, and the inner sheet Tc of the booklet T is raised and turned as shown in FIG. 19 to FIG. 21.

By the way, when the upper vacuum pads 10*a* are pressed against the upper surface portion of the inner sheet Tc of the booklet T, the booklet T bends and deforms downward as described above. At this occasion, the conveying guide 44 and the auxiliary rollers 47 receive the booklet T and limits the downward bending/deformation of the booklet T.

Therefore, when the inner sheet Tc of the booklet T is raised, the inner sheet Tc buckles in a clear S-shape as shown in FIG. 20, and a page below the sucked/held inner sheet Tc can be reliably separated.

When one of the pair of lower vacuum pads 10*b* is pressed against the lower surface portion of the booklet T, the booklet T bends and deforms upward. At this occasion, the receiving plate 51 receives the booklet T and limits the deformation. When the other of the pair of lower vacuum pads 10*b* is pressed against the lower surface portion of the booklet T, the booklet T bends and deforms upward. However, since the portion against which the other of the vacuum pads 10*b* is pressed is in proximity to the stitch portion Tb of the booklet T having a high degree of rigidity, where the upward bending/deformation is limited.

Therefore, the pair of lower vacuum pads 10*b* can suck and hold the lower surface portion of the booklet T in a preferable manner.

As described above, according to the first embodiment, the conveying guide 44 and the auxiliary rollers 47 are provided at the page turning position 5. When the upper vacuum pads 10*a* are pressed against the upper surface portion of the inner sheet Tc of the booklet T, the conveying guide 44 and the auxiliary rollers 47 limit downward bending of the booklet T. Therefore, when the upper vacuum pads 10*a* raise the inner sheet Tc of the booklet T, the inner sheet Tc buckles in a clear S-shape, and a page below the sucked/held inner sheet Tc can be reliably separated.

Further, the receiving plate 51 is integrally arranged between the pair of upper vacuum pads 10*a* in such a manner that the receiving plate 51 is arranged slightly above the sucking/holding surfaces of the pair of upper vacuum pads 10*a*. The receiving plate 51 receives the upper surface side of the booklet T against which one of the lower vacuum pads 10*b* is pressed. The other of the vacuum pads 10*b* is pressed against a portion in proximity to the highly rigid booklet stitch portion Tb. Therefore, bending/deformation of the booklet T can be limited, and the pair of lower vacuum pads 10*b* can suck and hold the lower surface portion of the booklet T in a preferable manner.

Second Embodiment

Figure 22:
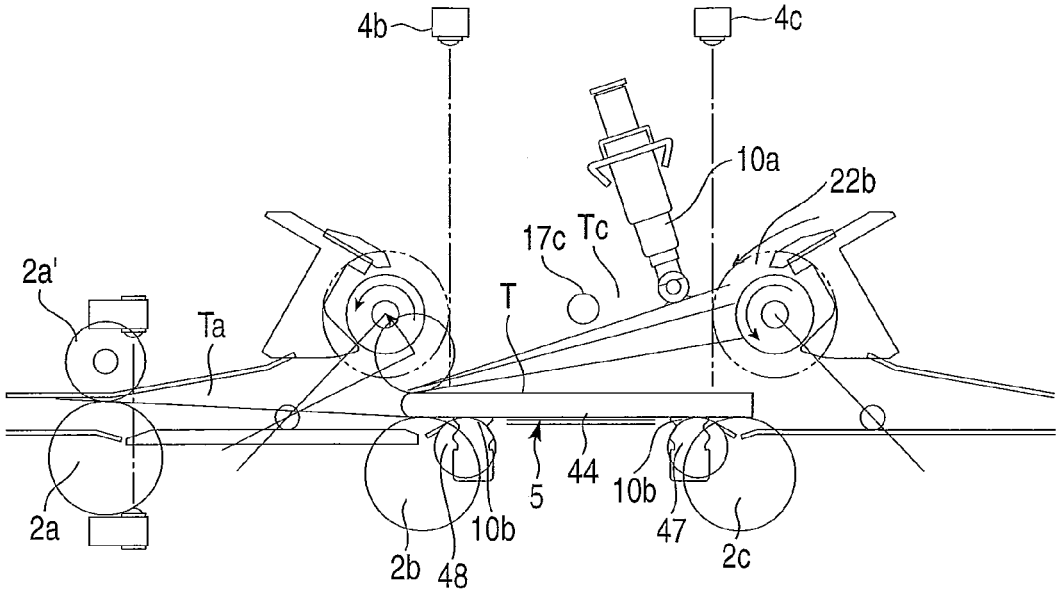
FIG. 22 is a figure illustrating separation operation of step 1 performed with bladed wheels of a page turning apparatus according to the second embodiment.
Figure 23:
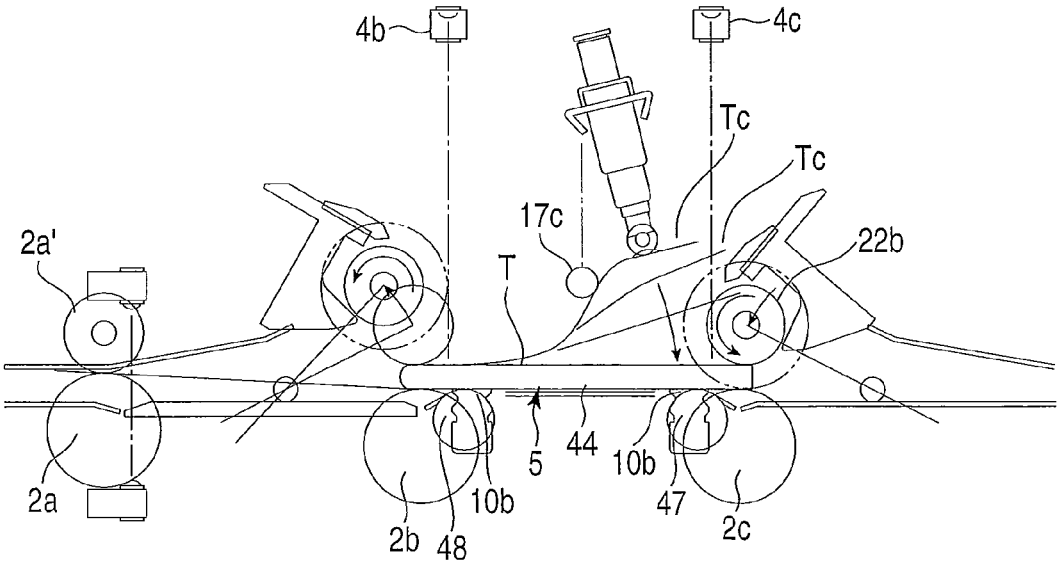
FIG. 23 is a figure illustrating separation operation of step 2 performed with the bladed wheels of FIG. 22.

FIG. 22, FIG. 23 illustrate the second embodiment.

The second embodiment is as follows. When upper vacuum pads 10*a* raise inner sheets Tc, rotating bladed wheels 22*b* are brought into contact with a front end edge of the inner sheets Tc while the inner sheets T are being raised as shown in FIG. 22 (step 1). Subsequently, as shown in FIG. 23, the inner sheets Tc come into contact with a drive shaft 17*c* and secondarily buckle in an S-shape. The rotating bladed wheels 22*b* move to the lower side of the inner sheets Tc so as to scratch and bring down the dropping inner sheets Tc (step 2).

In the past, the bladed wheels 22*b* are used only in the state of step 2 of FIG. 23.

In this second embodiment, step 1 of FIG. 22 is newly added before step 2. Therefore, in the second embodiment, the plurality of sucked/held inner sheets Tc can be scratched and brought down by the bladed wheels 22*b*. In order to achieve this, the raised positions of the upper vacuum pads 10*a* are equal to or lower than the height at which the cover Ta is turned.

It should be noted that the operation of step 1 can be applied to not only the inner sheets Tc but also turning of the cover Ta. Therefore, the inner sheets Tc electrostatically adhering to the back side of the cover Ta can be scratched and brought down.

When the page raise speed is set at a relatively high speed in step 1, it is more effective to turn a plurality of inner sheets Tc adhering to each other due to roughness of fibers. In other words, the longer the upper vacuum pads 10*a* are pressed, the more air passes through the fibers of the inner sheets Tc. Accordingly, as soon as a predetermined degree of vacuum (allowing raise) is obtained, it is raised as soon as possible. As a result, the performance for separating each sheet can be enhanced.

On the other hand, when the page raise speed of step 2 after step 1 is set at a relatively low speed, it is more effective to successfully separate each sheet. In other words, the upper sucking/holding may be detached even by a small impact because of deformation resistance that causes buckling in the S-shape. Therefore, it is more preferable to cause the inner sheet to buckle over a longer time as long as it does not exceed a tact time.

In another embodiment, sheet separation of step 2 may be performed first, and thereafter, sheet separation of step 1 may be performed.

Third Embodiment

Figure 24:
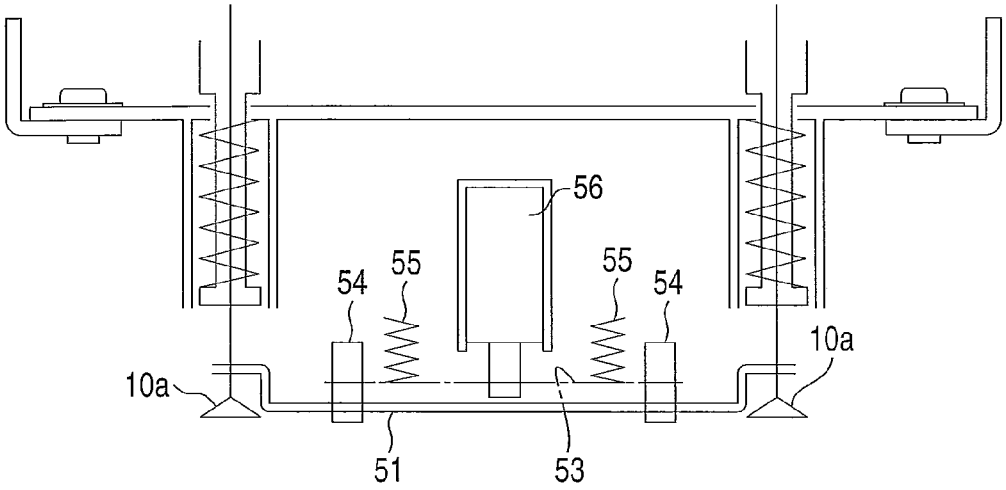
FIG. 24 is a figure illustrating a page turning apparatus according to the third embodiment.

FIG. 24 illustrates the third embodiment.

In the third embodiment, a pair of small pinch rollers 54 coupled with a shaft 53 are provided on a receiving plate 51 in such a manner that the pair of small pinch rollers 54 can freely protrude or retract. The pair of small pinch rollers 54 are elastically urged downward by a spring 55. The pair of small pinch rollers 54 protrude from or retract into the receiving plate 51 when a solenoid 56 is turned on/off.

The pair of small pinch rollers 54 are configured such that lower end portions of the small pinch rollers 54 comes out of the receiving plate 51 to the lower side or comes into the receiving plate 51 according to the change of the thickness of the booklet T, so as to guide the booklet T.

According to the third embodiment, the pair of small pinch rollers 54 are provided on the receiving plate 51 retracting with a stroke in synchronization with the upper vacuum pads 10*a*. Therefore, the distance of operation for extending and retracting the small pinch rollers 54 can be reduced, which allows reducing the size of the apparatus.

When the sucking/holding force of the upper vacuum pads 10*a* is sufficiently larger than the pinching force of the small pinch rollers 54, it may be possible to omit the operation (and the mechanism) for extending and retracting the small pinch rollers 54 with the solenoid 52.

Fourth Embodiment

FIG. 25 to FIG. 29 illustrate the fourth embodiment.

Figure 25:
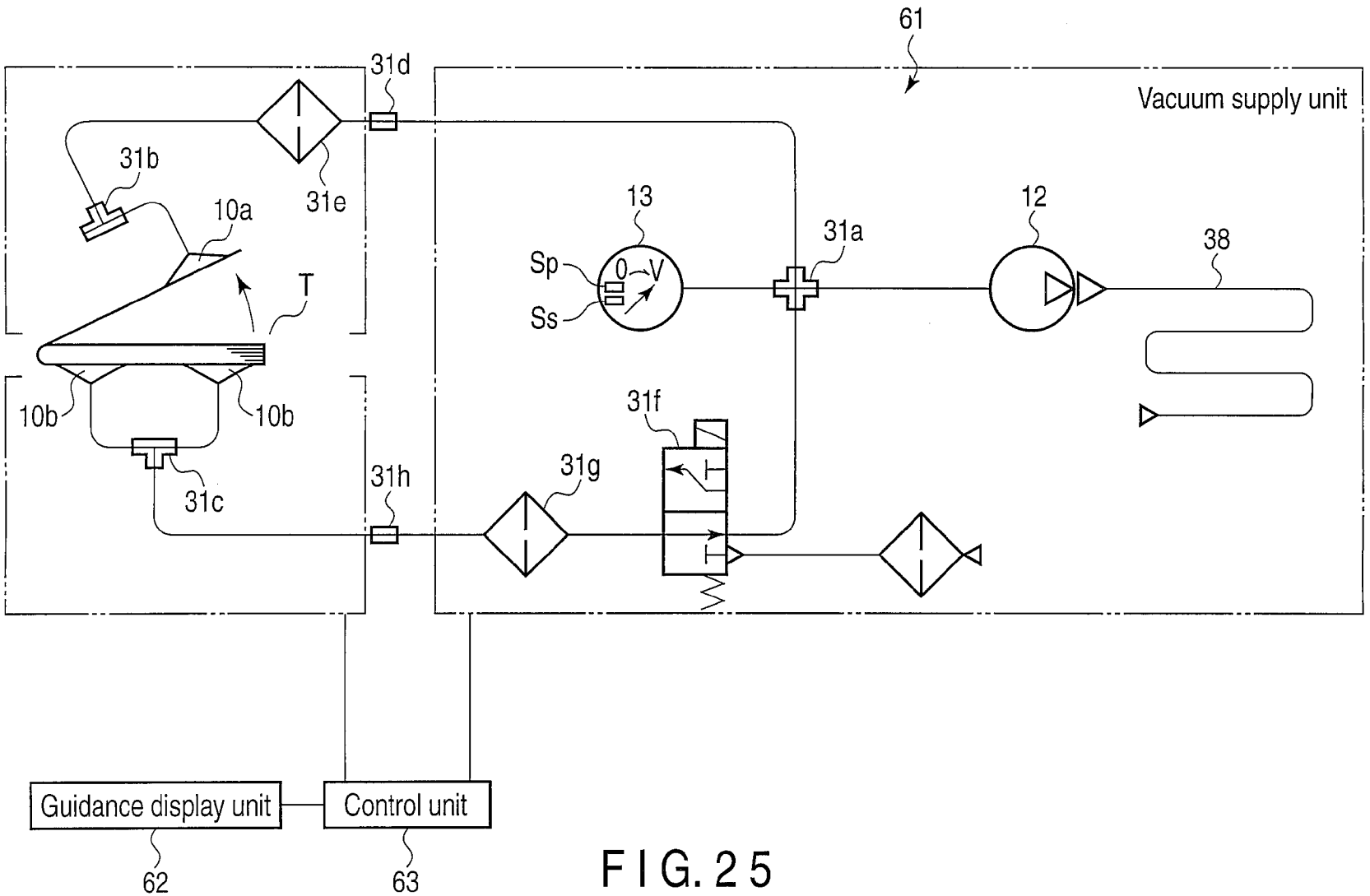
FIG. 25 is a schematic diagram illustrating a vacuum supply circuit according to the fourth embodiment.

FIG. 25 illustrates a vacuum supply circuit 61 for providing vacuum to the upper and lower vacuum pads 10*a*, 10*b*. A vacuum pump 12 and the upper and lower vacuum pads 10*a*, 10*b* are connected via the vacuum supply circuit 61.

In other words, the vacuum pump 12 is connected to the upper vacuum pads 10*a* via a branching unit 31*a*, a connection unit 31*d*, a filter 31*e*, and a branching unit 31*b*. The vacuum pump 12 is connected to the lower vacuum pads 10*b* via the branching unit 31*a*, an electromagnetic valve 31*f*, a filter 31*g*, a connection unit 31*h*, and a branching unit 31*c*.

Further, the branching unit 31*a* is connected to a pressure meter 13 serving as a vacuum degree measurement device. The pressure meter 13 has a vacuum switch Sp and a vacuum switch Ss. The vacuum switch Sp and the vacuum switch Ss are connected to a control unit 63 serving as first and second control devices. The control unit 63 is connected to a guidance display unit 62. An exhaust path 38 having silencing function is connected to an exhaust side of the vacuum pump 12.

Figure 26:
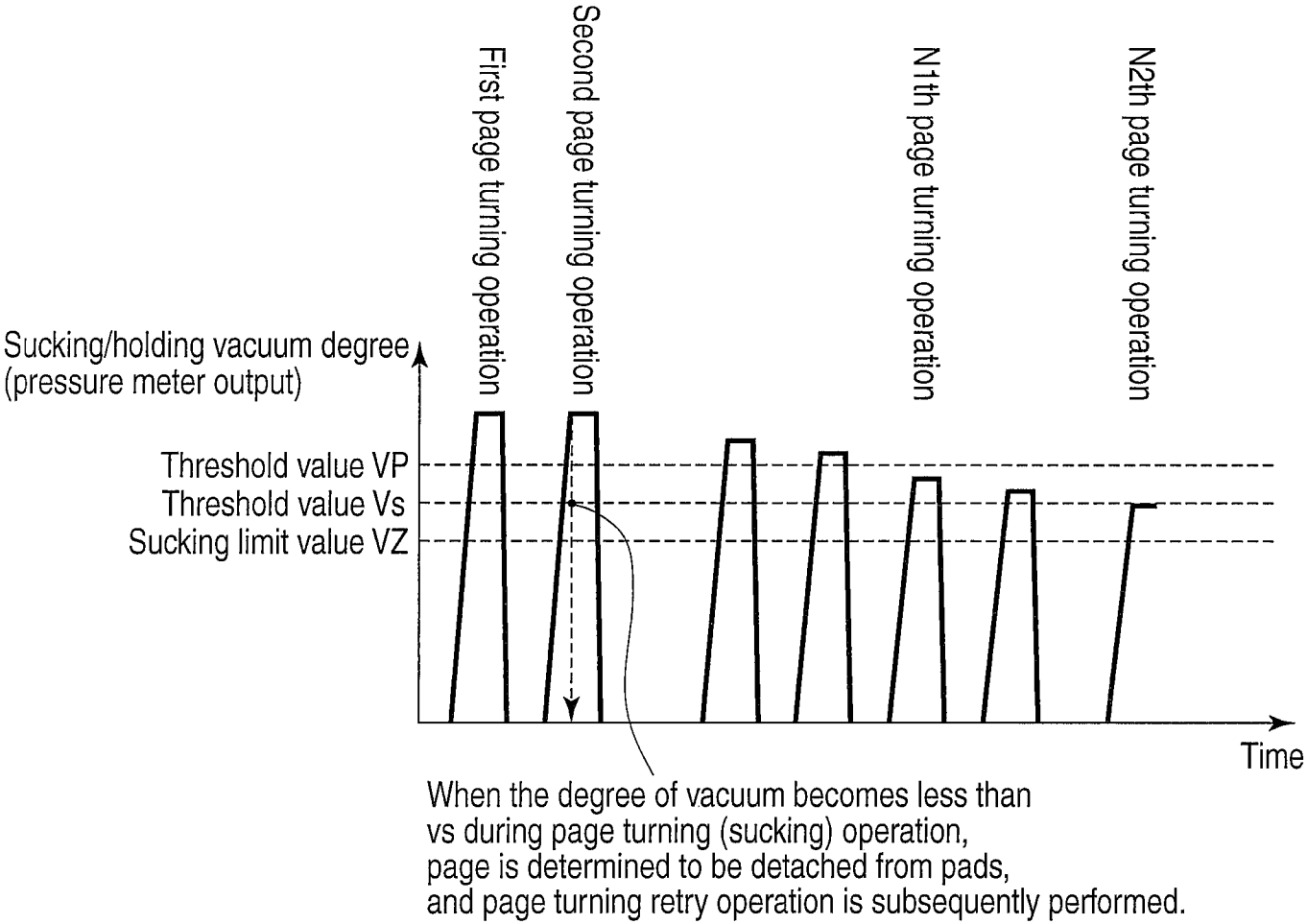
FIG. 26 is a graph illustrating change of the degree of vacuum when the upper vacuum pads of FIG. 25 suck and hold a page.

FIG. 26 is a graph illustrating change of the degree of vacuum at the upper vacuum pads 10*a* during the page turning operation.

When the sucking/holding vacuum degree of the upper vacuum pads 10*a* is more than a threshold value Vp, the vacuum switch Sp of the pressure meter 13 is turned on. When the sucking/holding vacuum degree of the upper vacuum pads 10*a* is more than a threshold value Vs, the vacuum switch Ss of the pressure meter 13 is turned on. A threshold value Vz is a sucking/holding limit value. A page can be raised, as long as the sucking/holding vacuum degree is equal to or more than the sucking/holding limit value Vz.

The threshold value Vz is set at 50 kPa, for example. When an ideal sucking/holding state (pump maximum vacuum degree) without any deterioration or air leak is 75 kPa, the threshold value Vp is set at 70 kPa, and the threshold value Vs is set at 60 kPa.

At the start of the page turning operation, when the degree of vacuum of the upper vacuum pads 10*a* is more than the threshold value Vs, the vacuum switch Ss of the pressure meter 13 is turned on. Accordingly, the control unit 63 executes a series of page turning operation. Then, when the vacuum switch Ss is turned off during this series of page turning operation, the control unit 63 determines that the inner sheet Tc is detached from the upper vacuum pads 10*a*, and performs control so as to proceed to page turning retry operation.

Further, the control unit 63 counts the number of times the vacuum switch Sp is turned off during the series of page turning operation, and monitors a ratio of the number of times the vacuum switch Sp is turned off with respect to the total number of times pages are turned or the number of times pages are turned in that day so as to determine whether the ratio is more than a predetermined value (for example, 1%). The control unit 63 is programmed to cause the guidance display unit 62 to display, as a guidance, the reduction of the degree of vacuum (certain deterioration) when the ratio of the number of times the vacuum switch Sp is turned off is determined to be more than the predetermined value.

When the degree of vacuum is not more than the threshold value Vs, and the vacuum switch Ss is still off at the start of the page turning operation, a predetermined number of retry operations are performed. When the page turning operation cannot be performed even after the predetermined number of retry operations, the control unit 63 causes the guidance display unit 62 to display an error to prompt a user to replace the upper vacuum pads 10*a* and check components. After the above processing is performed, the page turning apparatus recovers from the error.

In reality, the page turning operation can be performed as long as the degree of vacuum is equal to or more than the threshold value Vz. Therefore, the page turning apparatus can at least operate if the threshold value Vs is set at a value closer to the threshold value Vz. However, since this embodiment is made for the purpose of prediction, the explanation has been made according to the flow as described above.

On the other hand, when the vacuum switch Ss is turned off during the series of page turning operation, the control unit 63 determines that the inner sheet Tc is detached from the upper vacuum pads 10*a* as described above, and proceeds to the page turning retry operation. At this occasion, the control unit 63 adjusts page turning parameters so as to reduce the amount of change of the secondary buckling of the inner sheet Tc of the booklet T, thus preventing detachment of a page.

When a page is detached again in the first retry operation, the control unit 63 repeatedly perform the retry operation. For every retry operation, the parameters are adjusted to reduce the amount of change of the secondary buckling. The retry operation is performed for a number of times equal to or less than a predetermined number of times.

The method for reducing the amount of change of the secondary buckling of the inner sheet Tc of the booklet T during the retry operation is as follows.

Figure 27:
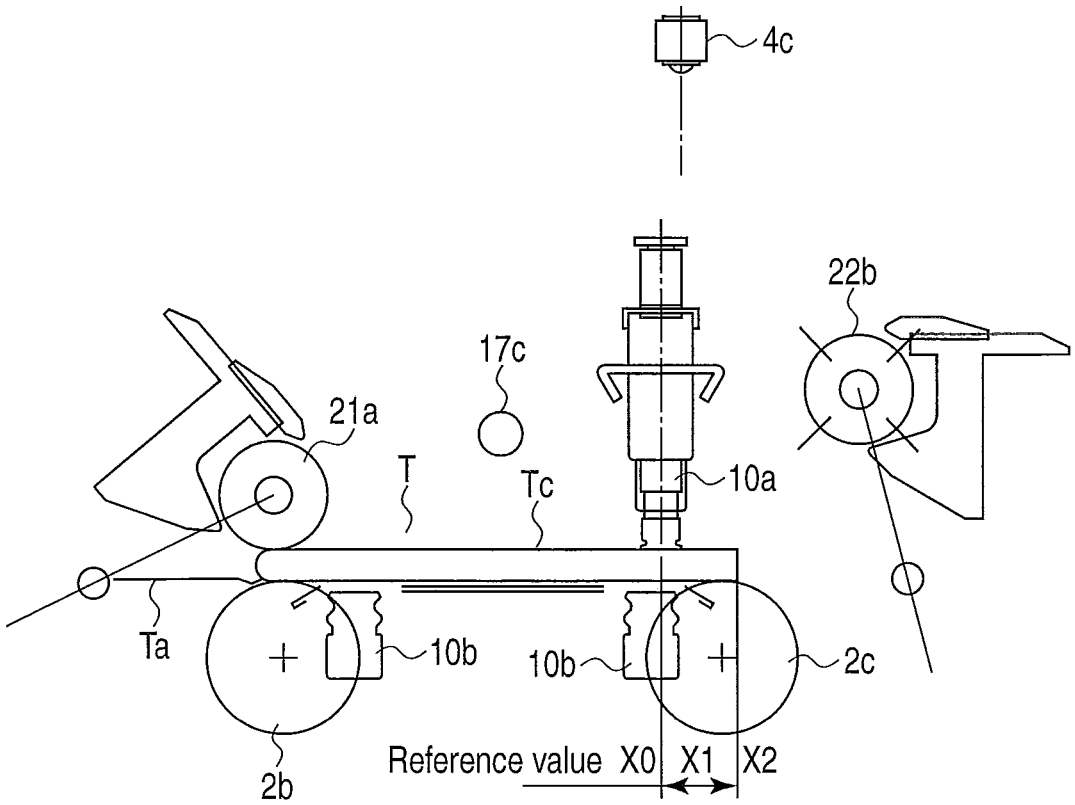
FIG. 27 is a figure illustrating a page sucking/holding position of the upper vacuum pads of FIG. 25.

FIG. 27 illustrates a sucking/holding position of the upper vacuum pads 10*a*. A sucking/holding position X0 represents a normal sucking/holding position. A sucking/holding position X1 represents a sucking/holding position for the first retry operation located closer to the front end side of the booklet T than the sucking/holding position X0. A sucking/holding position X2 represents a sucking/holding position for the second retry operation located closer to the front end side of the booklet T than the sucking/holding position X1.

As the sucking/holding position of the upper vacuum pads 10*a* move to the front end side of the booklet T from the position X0, the amount of change of the secondary buckling of the inner sheet Tc decreases, and a page is less likely to be detached from the upper vacuum pads 10*a*.

Figure 28:
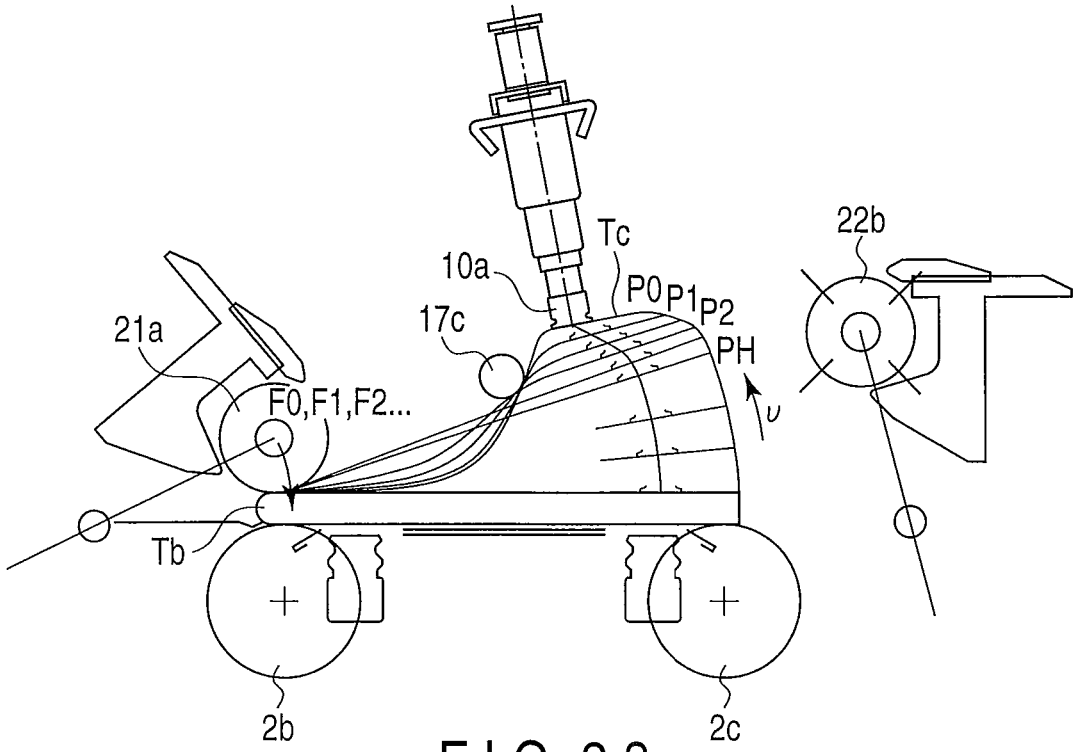
FIG. 28 is a figure illustrating heights of a page raised by the upper vacuum pads of FIG. 25.

FIG. 28 illustrates a raised height of the inner sheet Tc with the upper vacuum pads 10*a*, a page raise speed of the inner sheet Tc, and pressing force applied by the pinch rollers 21*a* onto the stitch portion Tb of the booklet T.

A raised height P0 of the inner sheet Tc represents a normal raised height of the inner sheet Tc. A raised height P1 represents a raised height of the inner sheet Tc for the first retry operation. A raised height P2 represents an inner sheet raised height for the second retry operation which is lower than the raised height for the first retry operation. A raised height PH represents a raised height for a rigid page such as a cover.

The lower the raised height of the inner sheet Tc is, the smaller the amount of change of the secondary buckling of the inner sheet Tc is, and the less likely the page is detached from the upper vacuum pads 10*a*.

The slower the page raise speed of the inner sheet Tc is, the smaller the amount of change of the secondary buckling of the inner sheet Tc is, and the less likely the page is detached from the upper vacuum pads 10*a*.

A pressing force F0 of the stitch portion Tb of the booklet T represents a normal pressing force. A pressing force F1 represents a pressing force for the first retry operation which is weaker than the normal pressing force. A pressing force F2 represents a pressing force for the secondary retry operation which is weaker than the pressing force for the first retry operation.

The weaker the pressing force of the stitch portion Tb of the booklet T is, the smaller the amount of change of the secondary buckling of the inner sheet Tc is, and a page is less likely to be detached from the upper vacuum pads 10*a*.

By the way, there is a problem in that sheet separation performance deteriorates when the amount of change of the secondary buckling of the inner sheet Tc is reduced.

To overcome this problem the control unit 63 maintains sheet separation performance at a high level by adjusting the parameters so as to enhance scratching/bringing-down function achieved by the bladed wheels 22*a*, 22*b*, i.e., another sheet separation function.

A method for enhancing the page scratching/bringing-down function achieved with the bladed wheels 22*a*, 22*b* is as follows.

Figure 29:
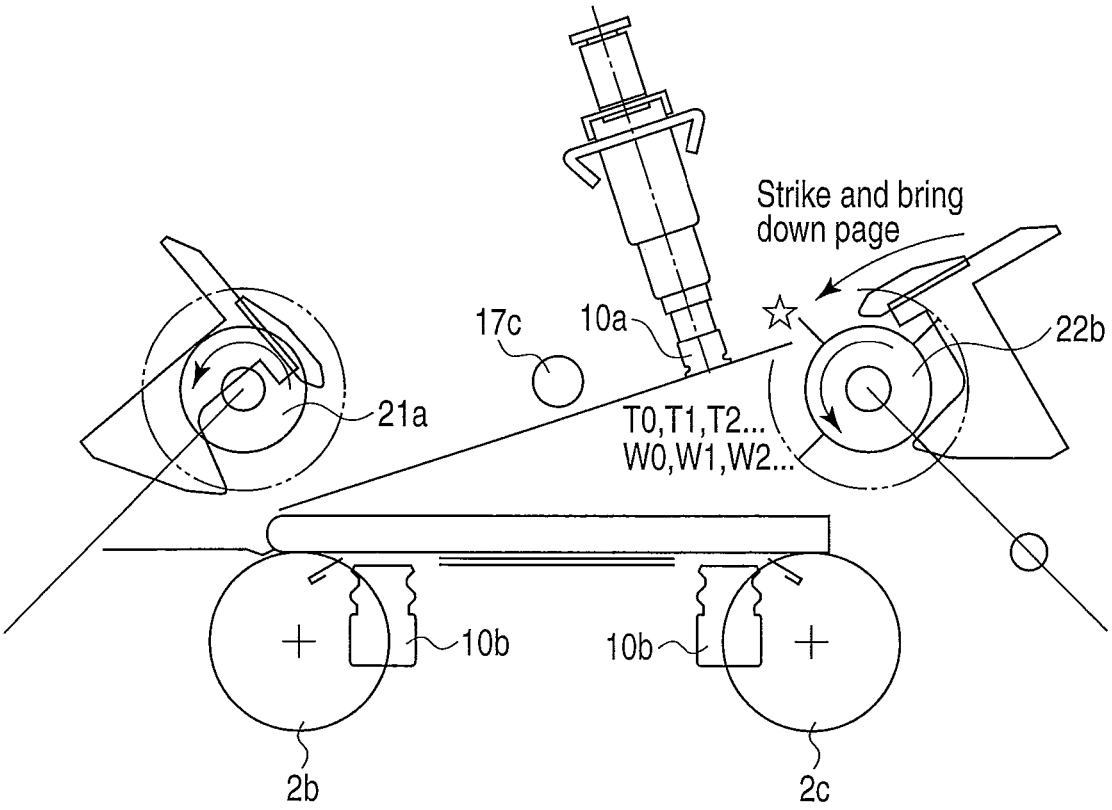
FIG. 29 is a figure illustrating rotational speeds of the bladed wheels when page turning process is retried.

FIG. 29 illustrates a contact time of the bladed wheels 22*a*, 22*b* coming into contact with the inner sheets Tc raised by the upper sucking/holding pads 10*a* and a rotational speed of the bladed wheels 22*a*, 22*b*.

A contact time T0 of the bladed wheels 22*a*, 22*b* represents a normal contact time of the bladed wheels 22*a*, 22*b*. A contact time T1 represents a contact time for the first retry operation which is longer than the normal contact time. A contact time T2 represents a contact time for the secondary retry operation which is longer than the contact time for the first retry operation. The longer the contact time of the bladed wheels 22*a*, 22*b* is, the higher the sheet separation performance is.

A rotational speed W0 of the bladed wheels 22*a*, 22*b* represents a normal rotational speed of the bladed wheels 22*a*, 22*b*. A rotational speed W1 represents a rotational speed for the first retry operation which is faster than the normal rotational speed. A rotational speed W2 represents a rotational speed for the second retry operation which is faster than the rotational speed for the first retry operation. The faster the rotational speed of the bladed wheels 22*a*, 22*b* is, the higher the sheet separation performance is.

In addition to the adjustment of the contact time of the bladed wheels 22*a*, 22*b* coming into contact with the inner sheets Tc and the rotational speed of the bladed wheels 22*a*, 22*b*, the pinch rollers 21*a* holding the stitch portion Tb of the booklet T may be, for example, reciprocally moved up and down, so that the pinch rollers 21*a* strike the upper surface of the S-shaped form of the inner sheets Tc to separate each sheet.

This operation may also be added in the following case: in the page number detection after the turning operation, the detection sensor 24 finds that two sheets are turned together even after the above retry operations is repeated, and determines that sheet separation has failed.

For example, the following application may be considered. When the booklet is determined to be an irregular booklet having burrs at the edges of the inner sheets Tc which are likely to adhere to each other, this operation may be added in advance for the page turning processings of the booklet T (turning another page, turning another page backward) performed thereafter.

On the other hand, when the upper vacuum pads 10*a* are replaced with new ones, the control unit 63 performs control to set the conditions used during the retry operation, and turn a predetermined number of pages under the conditions thus set, thus sufficiently performing aging (burn-in).

Subsequently, the retry operation of page turning operation will be explained.

When the degree of vacuum of the upper vacuum pads 10*a* becomes equal to or less than the threshold value Vs during the series of the page turning operation of the inner sheet Tc of the booklet T, the vacuum switch Ss is turned off. In this case, the control unit 63 determines that the inner sheet Tc is detached from the upper vacuum pads 10*a*, and causes the upper vacuum pads 10*a* to retry the page turning operation.

During the retry operation, at least one of the raised height of the inner sheet Tc with the upper vacuum pads 10*a*, the page raise speed, the sucking/holding position, and the pressing force of the stitch portion Tb of the booklet T is changed and adjusted.

More specifically, compared with the normal operation, the raised height of the inner sheet Tc is reduced, the page raise speed is reduced, the sucking/holding position is moved to the front end side of the booklet T, or the pressing force applied to the stitch portion Tb of the booklet T is reduced. With this adjustment, the amount of change of the secondary buckling of the booklet T can be reduced, and the inner sheet Tc is less likely to be detached from the upper vacuum pads 10*a*.

During this retry operation, the amount of change of the secondary buckling of the inner sheet Tc is less than that of the normal operation. Therefore, the sheet separation performance deteriorates during this retry operation. To solve this problem, the contact time of the bladed wheels 22*a*, 22*b* coming into contact with the inner sheet Tc may be increased, or the rotational speed of the bladed wheels 22*a*, 22*b* is increased at this moment.

As a result, when the contact time or the rotational speed are thus changed, the sheet separation performance of the inner sheets Tc separated by the bladed wheels 22*a*, 22*b* can be enhanced, and this compensate the deterioration of the sheet separation performance caused by the decrease in the amount of change of the secondary buckling of the booklet T.

When, even after this retry operation, the degree of vacuum of the upper vacuum pads 10*a* becomes equal to or less than the threshold value Vs, and the vacuum switch Ss is turned off, the control unit 63 retries the turning operation again.

Every time the retry operation is repeated, the amount of change of the secondary buckling of the booklet T is adjusted and reduced, and the adjustment is made so as to enhance the sheet separation performance of the bladed wheels 22*a*, 22*b*.

This retry operation is repeatedly continued until the degree of vacuum of the upper vacuum pads 10*a* becomes equal to or more than the threshold value Vs and the vacuum switch Ss is turned on.

Subsequently, use of new upper vacuum pads will be explained.

When the upper vacuum pads 10*a* are replaced with new ones, the control unit 63 performs control so as to perform the page turning operation for a predetermined number of sheets under the condition in which the parameters used during the retry operation are already employed.

As a result, even when the rubber surfaces of the new upper vacuum pads 10*a* are covered with deteriorated oxide films, the upper vacuum pads 10*a* can prevent a page from being detached from the upper vacuum pads 10*a*.

After the upper vacuum pads 10*a* are subjected to sufficient aging (burn-in), the deteriorated oxide films on the rubber surface of the upper vacuum pads 10*a* are eliminated because the deteriorated oxide films are scraped against the sheet surfaces of the pages. Therefore, a page is less likely to be detached from the pad sucking/holding surfaces. In this state, the conditions are changed back to the normal page turning conditions, and the page turning operation is resumed.

Subsequently, prediction of deterioration of the upper vacuum pads 10*a* and a display for prompting replacement will be explained.

When the number of page turning operations of the booklet (the number of processed sheets of the booklet) increases, the degree of deterioration of the upper vacuum pads 10*a* increases. As a result, as shown in FIG. 26, when the degree of vacuum of the upper vacuum pads 10*a* becomes less than the threshold value Vp at a page-turning operation number N1, the vacuum switch Sp is turned off. The control unit 63 monitors a ratio of the number of times the vacuum switch Sp is turned off with respect to the total number of times pages are turned by the page turning apparatus or the number of times pages are turned in that day, and determines whether the ratio is more than a predetermined value (for example, 1%). When the ratio is determined to be more than the predetermined value, the control unit 63 causes the guidance display unit 62 to display, as a guidance, the reduction of the degree of vacuum (certain deterioration). In this state where the degree of vacuum is low, the page turning operation is still possible but the upper vacuum pads 10*a* are further deteriorated. When the page turning operation starts, the degree of vacuum cannot exceed the threshold value Vs (i.e., the vacuum switch Ss is kept off). In this case, even when a predetermined number of retry operations are performed, it is impossible to perform the page turning operation. In this state, the control unit 40 causes the guidance display unit 62 to display an error to prompt a user to replace the upper vacuum pads 10*a* and check components. After the above processing is performed, the page turning apparatus recovers from the error.

As described above, according to the fourth embodiment, when the inner sheet Tc is detached from the upper vacuum pads 10*a* during the page turning operation of the inner sheet Tc, the page turning operation is retried so as to reduce the amount of change of the buckling of the inner sheet Tc in the S-shape. Therefore, the fourth embodiment can prevent a page from being detached from the vacuum pads 10*a* without increasing the sucking/holding force of the upper vacuum pads 10*a*.

When new upper vacuum pads are used, the page turning operation for a predetermined number of sheets is performed under the condition in which the parameters used during the retry operation are already employed. Therefore, even when the rubber surfaces of the new upper vacuum pads 10*a* are covered with deteriorated oxide films, the upper vacuum pads 10*a* can prevent a page from being detached from the upper vacuum pads 10*a*.

Further, when the ratio of the number of times the vacuum switch Sp is turned off with respect to the total number of times pages are turned by the page turning apparatus or the number of times pages are turned in that day is determined to be more than a predetermined value (for example, 1%), the guidance display unit 62 can display, as a guidance, the reduction of the degree of vacuum (certain deterioration). Therefore, it is possible to prepare for replacing the upper vacuum pads with new ones.

On the other hand, when the degree of vacuum of the sucking/holding pads 10*a* cannot exceed the threshold value Vs (the vacuum switch Ss is still off) at the start of the page turning operation, the guidance display unit 62 displays an error to prompt a user to replace the upper vacuum pads 10*a* and check components. Accordingly, the user can immediately perform replacement and checking operations.

Fifth Embodiment

FIG. 30 to FIG. 33 illustrate the fifth embodiment.

Figure 30:
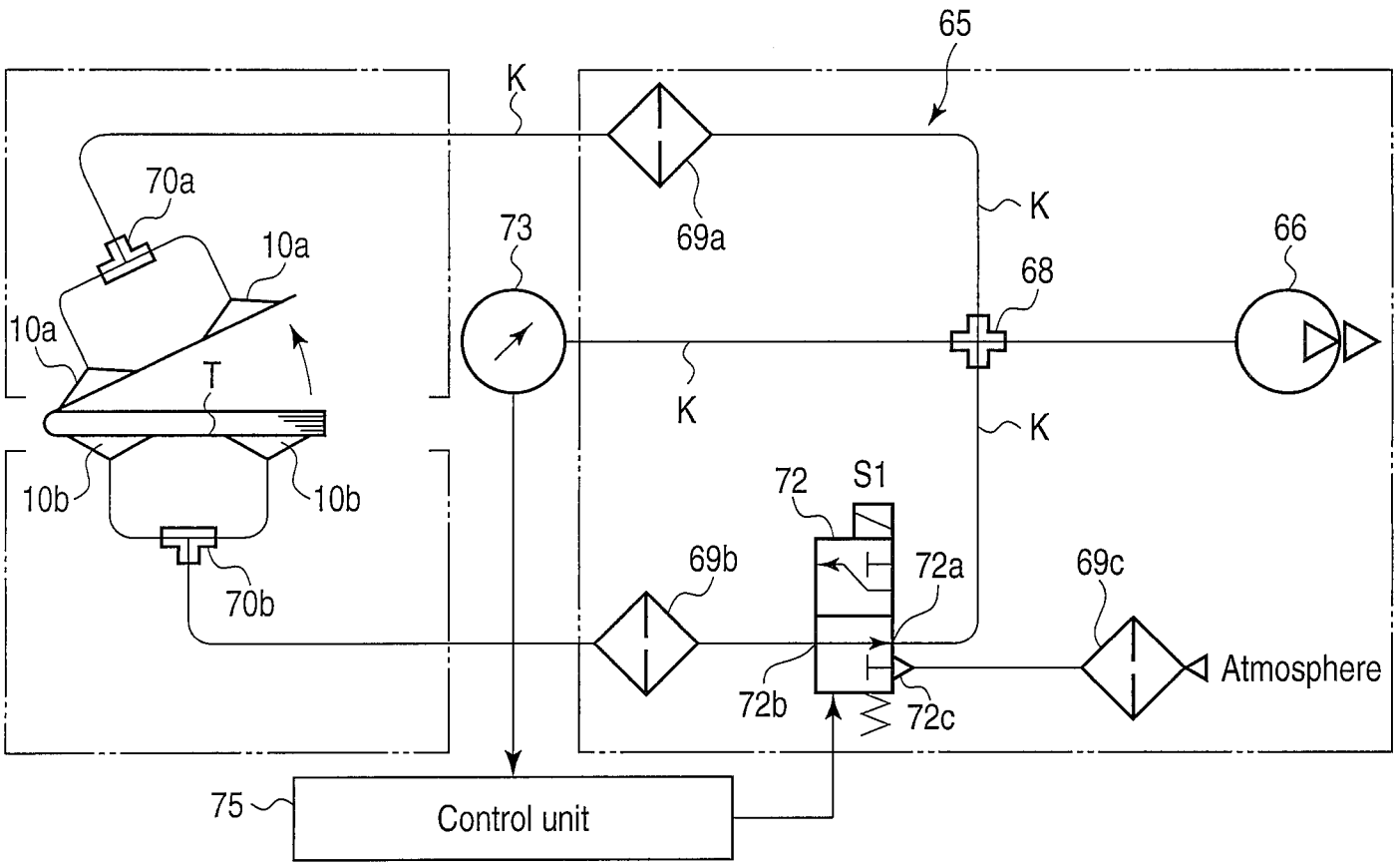
FIG. 30 is a figure illustrating a vacuum supply circuit according to the fifth embodiment when upper sucking/holding pads raise a page.

FIG. 30 illustrates a vacuum supply circuit 65 for providing vacuum to the upper and lower vacuum pads 10*a*, 10*b*.

The vacuum or vacuum state referred to herein does not necessarily mean that the air does not exist at all or the air hardly exists. The vacuum or vacuum state means that the air is thinner than the ambient air and the air has such a negative pressure that the vacuum pads can suck and hold the surface of an opposing booklet.

The vacuum supply circuit 65 is connected to a vacuum pump 66 via a four-terminal branch tube 68. The four-terminal branch tube 68 is connected via an upper air tube K to an air filter 69*a*, a branch tube 70*a*, and upper vacuum pads 10*a* in order. Further, the four-terminal branch tube 68 is connected via a lower air tube K to an electromagnetic valve 72, an air filter 69*b*, a branch tube 70*b* and lower sucking/holding pads 10*b*.

The four-terminal branch tube 68 is connected via the air tube K to a pressure meter 73 serving as a vacuum pressure measurement device. This pressure meter 73 is connected to a control unit 75. The pressure meter 73 has the following functions. The pressure meter 73 measures the degree of vacuum in the air tube K. When the degree of vacuum is determined to be more than a configured threshold value, the pressure meter 73 transmits the signal to the control unit 75. The control unit 75 is connected to the electromagnetic valve 72. The electromagnetic valve 72 is controlled as explained below on the basis of the pressure value measured by the pressure meter 73.

The electromagnetic valve 72 is a single-acting universal electromagnetic valve having first to third terminals 72*a* to 72*c*. The first terminal 72*a* is connected to the upper air tube K. The second terminal 72*b* is connected to the lower air tube K. The third terminal 72*c* of the electromagnetic valve 72 is connected to the atmosphere via the air filter 69*c*. The air filters 69*a* to 69*c* have a function of removing dusts in the air passing through the air filters 69*a* to 69*c*.

When the electromagnetic valve 72 is energized/deenergized, the electromagnetic valve 72 is activated/deactivated, and attains the first and second states S1, S2.

Figure 31:
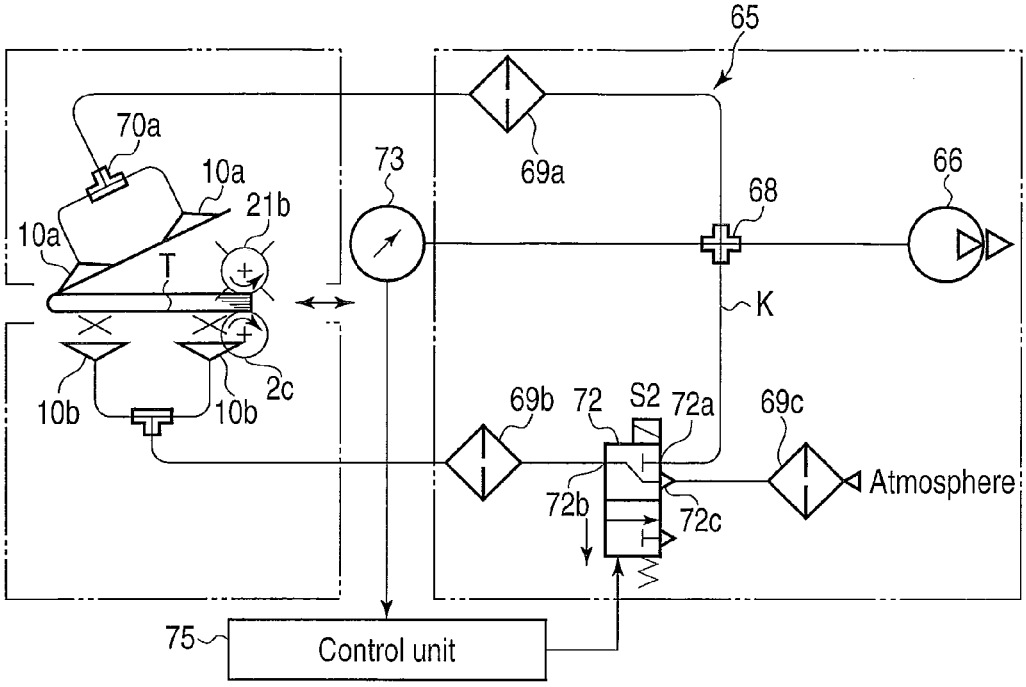
FIG. 31 is a figure illustrating the vacuum supply circuit when lower sucking/holding pads of FIG. 30 cancel sucking/holding and a booklet is conveyed while only the upper sucking/holding pads suck the page.

In other words, when the electromagnetic valve 72 is deenergized (normal state), the electromagnetic valve 72 attains the first state S1. When the electromagnetic valve 72 is energized, the electromagnetic valve 72 attains the second state S2, as shown in FIG. 31. When the electromagnetic valve 72 in this second state S2 is deenergized again, the electromagnetic valve 72 returns back to the first state S1.

When the electromagnetic valve 72 is in the first state S1, the first terminal 72*a* is connected to the second terminal 72*b*, and the air flows from the second terminal 72*b* to the first terminal 72*a*. In the first state S1, the lower sucking/holding pads 10*b* is evacuated, so that the lower sucking/holding pads 10*b* is ready to suck/hold the back surface of the booklet T.

When the electromagnetic valve 72 is in the second state S2, the second terminal 72*b* is connected to the third terminal 72*c*, and the air flows from the third terminal 72*c* to the second terminal 72*b*. In the second state S2, the atmosphere flows into the lower sucking/holding pads 10*b*, so that the lower sucking/holding pads 10*b* stops sucking/holding. When the electromagnetic valve 72 is deenergized again in this state, the electromagnetic valve 72 attains the first state S1, and the air flows from the second terminal 72*b* to the first terminal 72*a* of the electromagnetic valve 72. In this state, the upper sucking/holding pads 10*a* are also brought to the atmospheric state, so that the sucking/holding state is cancelled.

Figure 33:
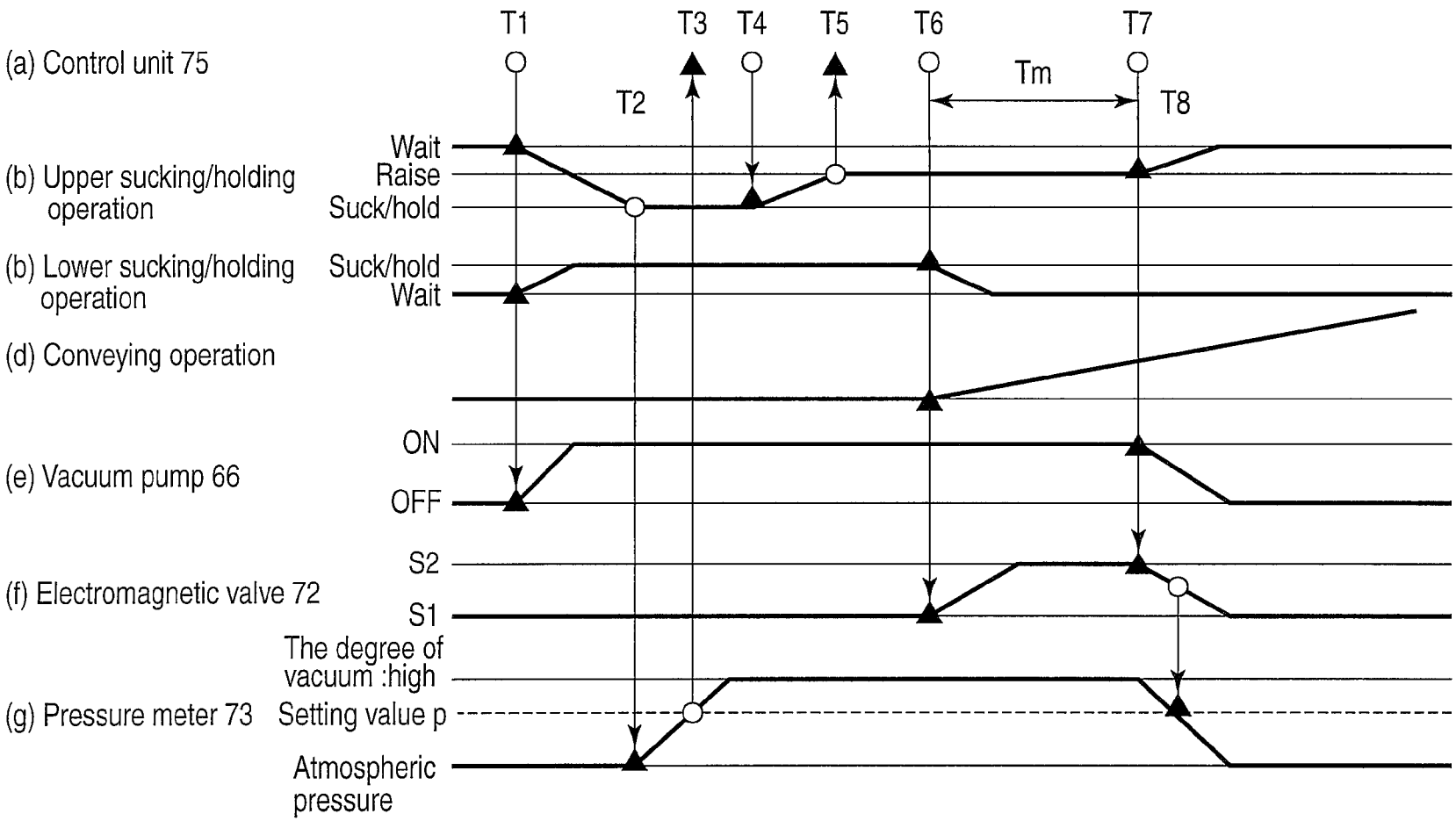
FIG. 33 is a figure illustrating a sequence of page turning operation performed with the vacuum supply circuit of FIG. 30.

FIG. 33 illustrates a sequence for achieving the page turning operation of the booklet T at the page turning position 5.

Items (a) to (g) of FIG. 33 represent the control unit 75, sucking/holding operation performed with the upper sucking/holding pads 10*a*, sucking/holding operation performed with the lower sucking/holding pads 10*b*, conveying operation of the booklet, and the states of the vacuum pump 66, the electromagnetic valve 72, and the pressure meter 73, respectively.

In FIG. 33, a white circle represents a trigger. A black triangle represents start of operation in response to the trigger.

The sucking/holding operation (b) of the upper vacuum pads 10*a* includes a waiting position, a raised position, and a sucking/holding position. The sucking/holding operation (c) of the lower vacuum pads 10*b* includes a waiting position and a sucking/holding position.

As shown in FIG. 30, when the electromagnetic valve 72 is in the first state S1, and the control unit 75 transmits a start instruction signal at a time T1, the vacuum state of the vacuum pump 66 changes from OFF to ON as shown in the item (e) of FIG. 33. Then, as shown in the items (b) and (c), the upper sucking/holding pads 10*a* and the lower sucking/holding pads 10*b* change from the waiting state to the sucking/holding state.

As shown in the item (g), the pressure value measured by the pressure meter 73 is low up to a time T2. When the pressure value exceeds a setting value p at a time T3, a control signal indicating that the pressure value exceeds the setting value p is transmitted to the control unit 75.

Then, as shown in the item (b), the control unit 75 transmits a control signal to the upper sucking/holding pads 10*a* to raise the page of the booklet T at a time T4. The upper sucking/holding pads 10*a* move upward from the sucking/holding position on the basis of the control signal, and reaches a raised position at a time T5. When the control unit 75 receives a signal indicating that the upper sucking/holding pads 10*a* reaches the raised position, the control unit 75 transmits a page turning/bringing-down instruction signal at a time T6. As a result, the contact roller 21*b* moves to a position immediately under the uppermost page Ta. At this time T6, the electromagnetic valve 72 changes to the second state S2 as shown in FIG. 31, and the lower sucking/holding pads 10*b* start canceling the vacuum state. Then, the bladed wheel rollers 20*b* and the conveyor roller 2*c* rotate, so that the booklet T is conveyed as shown in the item (d). As a result, the booklet T is sandwiched and conveyed to the right. As shown in the item (g), the upper sucking/holding pads 10*a* have a high degree of vacuum until a time Tm set as shown in the item (b) passes since the time T6 at which the conveying operation of the booklet T starts. Therefore, even after the lower sucking/holding pads 10*b* start canceling the vacuum state, the upper sucking/holding pads 10*a* keeps on sucking/holding the uppermost page Ta.

Figure 32:
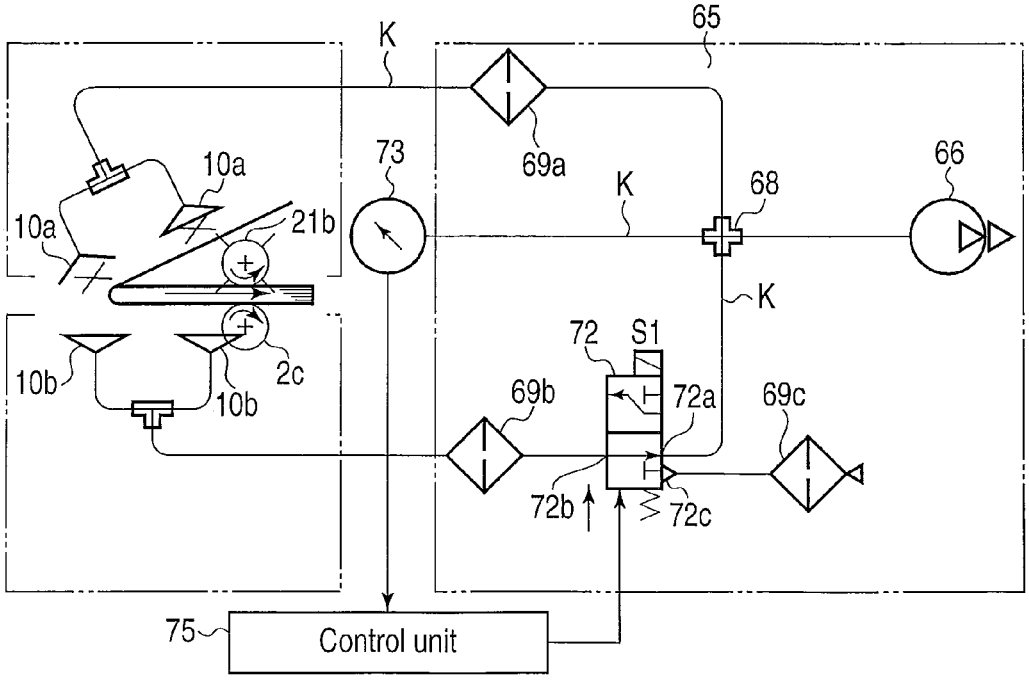
FIG. 32 is a figure illustrating the vacuum supply circuit when the upper sucking/holding pads of FIG. 31 cancel sucking/holding and the booklet is further conveyed.

After the lower sucking/holding pads 10*b* cancel the vacuum state, the configured time Tm passes since the time T6. At a time T7, as shown in the item (f), the electromagnetic valve 72 changes from the second state S2 to the first state S1 as shown in FIG. 32. As a result of this change, the upper sucking/holding pads 10*a* cancel the sucking/holding state. The uppermost page Ta detached from the upper vacuum pads 10*a* is pushed and brought down by the bladed wheel rollers 20B continuing conveying operation.

When the uppermost page Ta has been turned and brought down, the vacuum pump 66 stops, and the upper and lower vacuum pads 10*a*, 10*b* return back to the initial position (waiting position). The upper and lower vacuum pads 10*a*, 10*b* wait for a subsequent operation instruction.

The time Tm between the page turning/bringing-down start point (time T6) and the sucking/holding cancel point (time T7) of the upper sucking/holding pads 10*a* is appropriately set according to the paper material (rigidity) of pages to be turned and the binding force (binding behavior) at the booklet stitch. The adjustment of the time Tm allows stable page turning operation performed on various kinds of booklets.

As described above, according to the fifth embodiment, the upper vacuum pads 10*a* cancel sucking/holding after a predetermined time passes since the lower vacuum pads 10*b* cancel sucking/holding. Therefore, a page raised by the upper vacuum pads 10*a* is not conveyed together with the booklet T at a time, and the page can be conveyed with a time lag.

Therefore, unlike a conventional example in which both of the upper and lower vacuum pads 10*a*, 10*b* cancel sucking/holding at a time and a page raised by the upper vacuum pads 10*a* is conveyed together with the booklet T at a time, the fifth embodiment allows preferable page turning operation in which the bladed wheels 22*a* (22*b*) do not come into contact with the raised page to strike and bring down the raised page.

Further, the vacuum supply paths to the upper and lower vacuum pads 10*a*, 10*b* can be switched using only the single three-port electromagnetic valve 72. Therefore, the configuration can be simplified, and it is easy to control the valve.

While certain embodiments have been described, these embodiments have been presented by way of example only, and are not intended to limit the scope of the inventions. Indeed, the novel embodiments described herein may be embodied in a variety of other forms; furthermore, various omissions, substitutions and changes in the form of the embodiments described herein may be made without departing from the spirit of the inventions. The accompanying claims and their equivalents are intended to cover such forms or modifications as would fall within the scope and spirit of the inventions.

What is claimed is:

1. A booklet page turning apparatus comprising: a conveying device that conveys a booklet to a page turning position along a conveying path;

upper and lower vacuum pads configured to be pressed against and to suck and hold upper and lower surfaces of the booklet conveyed to the page turning position by the conveying device;

a drive device that moves the upper vacuum pad to raise, by a predetermined angle, a page of the booklet in a direction for opening the booklet about a stitch of the booklet;

a contact roller unit that moves into a position below the page raised by the predetermined angle; and a control device that performs control, such that the contact roller unit moves to the position below the page, thereafter the lower vacuum pad cancels sucking and holding the page and the booklet is conveyed for a predetermined distance, and thereafter the upper vacuum pad cancels sucking and holding the page, so that the page is turned.

2. The booklet page turning apparatus according to claim 1, further comprising:

a vacuum pump connected to the upper and lower vacuum pads via a vacuum supply circuit; and a single electromagnetic valve provided in the vacuum supply circuit for switching the vacuum supply circuit between a first path, a second path, and a third path, wherein the first path is configured to respectively provide vacuum to the upper and lower vacuum pads, the second path is configured to stop providing vacuum to the lower vacuum pad and provide vacuum only to the upper vacuum pad, and the third path is configured to stop providing vacuum to the upper and lower vacuum pads.

3. The booklet page turning apparatus according to claim 2, wherein it is possible to adjust a time from when the supply of vacuum to the lower sucking/holding pad is stopped to when the supply of vacuum to the upper sucking/holding pad is stopped.

4. The booklet page turning apparatus according to claim 2, further comprising a vacuum degree measurement device provided in the vacuum supply circuit for measuring a degree of vacuum provided to the upper and lower vacuum pads.

* * * * *